US009150320B2

(12) United States Patent
Wurster et al.

(10) Patent No.: US 9,150,320 B2
(45) Date of Patent: Oct. 6, 2015

(54) PLASTIC CONTAINERS HAVING BASE CONFIGURATIONS WITH UP-STAND WALLS HAVING A PLURALITY OF RINGS, AND SYSTEMS, METHODS, AND BASE MOLDS THEREOF

(75) Inventors: Michael P. Wurster, York, PA (US); Scott E. Bysick, Elizabethtown, PA (US)

(73) Assignee: GRAHAM PACKAGING COMPANY, L.P., York, PA (US)

( * ) Notice: Subject to any disclaimer, the term of this patent is extended or adjusted under 35 U.S.C. 154(b) by 41 days.

(21) Appl. No.: 13/210,350

(22) Filed: Aug. 15, 2011

(65) Prior Publication Data

US 2013/0043209 A1 Feb. 21, 2013

(51) Int. Cl.

| | |
|---|---|
| ***B65D 83/70*** | (2006.01) |
| ***B65B 61/24*** | (2006.01) |
| ***B65D 1/02*** | (2006.01) |
| ***B65D 79/00*** | (2006.01) |

(52) U.S. Cl.

CPC ..... *B65B 61/24* (2013.01); *B65D 1/0276* (2013.01); *B65D 79/005* (2013.01)

(58) Field of Classification Search

CPC .. B65D 1/0276; B65D 1/0261; B65D 79/005; B65D 2501/0036; B29C 49/541

USPC ..... 215/370–373, 376, 381, 382; 220/604–606, 608, 609

See application file for complete search history.

(56) References Cited

U.S. PATENT DOCUMENTS

| | | | | |
|---|---|---|---|---|
| 91,754 | A * | 6/1869 | Lawrence | 126/390.1 |
| 163,747 | A * | 5/1875 | Cummings | 126/390.1 |
| 1,351,496 | A * | 8/1920 | Spooner | 215/329 |
| 1,499,239 | A | 6/1924 | Malmquist | |
| 2,027,430 | A * | 1/1936 | Hansen | 220/624 |
| 2,142,257 | A | 1/1937 | Saeta | |
| D110,624 | S | 7/1938 | Mekeel, Jr. | |
| 2,124,959 | A * | 7/1938 | Vogel | 53/471 |
| 2,378,324 | A | 6/1945 | Ray et al. | |
| 2,880,902 | A | 4/1959 | Owsen | |
| 2,960,248 | A | 11/1960 | Kuhlman | |
| 2,971,671 | A * | 2/1961 | Shakman | 220/624 |
| 2,982,440 | A | 5/1961 | Harrison | |
| 3,043,461 | A | 7/1962 | Glassco | |

(Continued)

FOREIGN PATENT DOCUMENTS

| | | |
|---|---|---|
| AU | 2002257159 B2 | 4/2003 |
| CA | 2077717 A1 | 3/1993 |

(Continued)

OTHER PUBLICATIONS

International Search Report for PCT/US06/40361 dated Feb. 26, 2007.

(Continued)

*Primary Examiner* — Anthony Stashick

*Assistant Examiner* — Ned A Walker

(74) *Attorney, Agent, or Firm* — Baker Botts L.L.P.

(57) ABSTRACT

Base configurations for plastic containers having an inner wall and up-stand wall geometries to accommodate internal container pressures after hot-filling and sealing, corresponding plastic containers, and systems, methods, and base molds thereof. In some embodiments, the up-stand wall geometries include a plurality of stacked rings. The inner wall and up-stand wall geometries can be co-operatively operative to accommodate pressure variations within the jar.

15 Claims, 13 Drawing Sheets

(56) References Cited

U.S. PATENT DOCUMENTS 3,081,002 A * 3/1963 Tauschinski et al. ..... 222/105
3,090,478 A 5/1963 Stanley
3,142,371 A 7/1964 Rice et al.
3,174,655 A 3/1965 Hurschman
3,198,861 A 8/1965 Marvel
3,201,111 A 8/1965 Afton
3,301,293 A 1/1967 Santelli
3,325,031 A 6/1967 Singier
3,397,724 A 8/1968 Bolen et al.
3,400,853 A * 9/1968 Jacobsen ..... 220/624
3,409,167 A 11/1968 Blanchard
3,417,893 A 12/1968 Lieberman
3,426,939 A 2/1969 Young
3,441,982 A 5/1969 Tsukahara Hiroshi et al.
3,468,443 A 9/1969 Marcus
3,482,724 A * 12/1969 Heaton ..... 215/10
3,483,908 A * 12/1969 Donovan ..... 221/260
3,485,355 A 12/1969 Stewart
3,693,828 A 9/1972 Kneusel et al.
3,704,140 A 11/1972 Petit et al.
3,727,783 A 4/1973 Carmichael
3,791,508 A 2/1974 Osborne et al.
3,819,789 A 6/1974 Parker
3,904,069 A 9/1975 Toukmanian
3,918,920 A 11/1975 Barber
3,935,955 A 2/1976 Das
3,941,237 A 3/1976 MacGregor, Jr.
3,942,673 A 3/1976 Lyu et al.
3,949,033 A 4/1976 Uhlig
3,956,441 A 5/1976 Uhlig
3,979,009 A * 9/1976 Walker ..... 220/609
4,035,455 A 7/1977 Rosenkranz et al.
4,036,926 A 7/1977 Chang
4,037,752 A 7/1977 Dulmaine et al.
4,117,062 A 9/1978 Uhlig
4,123,217 A 10/1978 Fischer et al.
4,125,632 A 11/1978 Vosti et al.
4,134,510 A 1/1979 Chang
4,147,271 A * 4/1979 Yamaguchi ..... 220/606
4,158,624 A 6/1979 Ford et al.
4,170,622 A 10/1979 Uhlig
4,170,662 A 10/1979 Weiss et al.
4,174,782 A 11/1979 Obsomer
4,177,239 A 12/1979 Gittner et al.
4,219,137 A 8/1980 Hutchens
4,231,483 A 11/1980 Dechenne et al.
4,247,012 A 1/1981 Alberghini
4,249,666 A * 2/1981 Hubert et al. ..... 215/373
4,301,933 A 11/1981 Yoshino et al.
4,318,489 A 3/1982 Snyder et al.
4,318,882 A 3/1982 Agrawal et al.
4,338,765 A 7/1982 Ohmori et al.
4,355,728 A 10/1982 Ota et al.
4,377,191 A 3/1983 Yamaguchi
4,378,328 A 3/1983 Przytulla et al.
4,381,061 A 4/1983 Cerny et al.
D269,158 S 5/1983 Gaunt et al.
4,386,701 A 6/1983 Galer
4,407,421 A * 10/1983 Waugh ..... 215/12.2
4,436,216 A 3/1984 Chang
4,442,944 A * 4/1984 Yoshino et al. ..... 215/376
4,444,308 A * 4/1984 MacEwen ..... 206/249
4,450,878 A 5/1984 Takada et al.
4,465,199 A 8/1984 Aoki
4,495,974 A 1/1985 Pohorski
4,497,621 A 2/1985 Kudert et al.
4,497,855 A 2/1985 Agrawal et al.
4,525,401 A 6/1985 Pocock et al.
4,542,029 A 9/1985 Caner et al.
4,547,333 A 10/1985 Takada
4,585,158 A 4/1986 Wardlaw, III
4,610,366 A 9/1986 Estes et al.
4,628,669 A 12/1986 Herron et al.
4,642,968 A 2/1987 McHenry et al.
4,645,078 A 2/1987 Reyner
4,667,454 A 5/1987 McHenry et al.
4,684,025 A 8/1987 Copland et al.
4,685,273 A 8/1987 Caner et al.
D292,378 S 10/1987 Brandt et al.
4,701,121 A 10/1987 Jakobsen et al.
4,723,661 A 2/1988 Hoppmann et al.
4,724,855 A 2/1988 Jackson et al.
4,725,464 A 2/1988 Collette
4,747,507 A 5/1988 Fitzgerald et al.
4,749,092 A 6/1988 Sugiura et al.
4,769,206 A 9/1988 Reymann et al.
4,773,458 A 9/1988 Touzani
4,785,949 A 11/1988 Krishnakumar et al.
4,785,950 A 11/1988 Miller et al.
4,807,424 A 2/1989 Robinson et al.
4,813,556 A 3/1989 Lawrence
4,831,050 A 5/1989 Cassidy et al.
4,836,398 A 6/1989 Leftault, Jr. et al.
4,840,289 A 6/1989 Fait et al.
4,850,493 A 7/1989 Howard, Jr.
4,850,494 A 7/1989 Howard, Jr.
4,865,206 A 9/1989 Behm et al.
4,867,323 A 9/1989 Powers
4,880,129 A 11/1989 McHenry et al.
4,887,730 A 12/1989 Touzani
4,892,205 A 1/1990 Powers et al.
4,896,205 A 1/1990 Weber
4,921,147 A 5/1990 Poirier
4,927,679 A 5/1990 Beck
4,962,863 A 10/1990 Wendling et al.
4,967,538 A 11/1990 Leftault, Jr. et al.
4,978,015 A 12/1990 Walker
4,997,692 A 3/1991 Yoshino
5,004,109 A 4/1991 Bartley et al.
5,005,716 A * 4/1991 Eberle ..... 215/373
5,014,868 A 5/1991 Wittig et al.
5,020,691 A 6/1991 Nye
5,024,340 A 6/1991 Alberghini et al.
5,033,254 A 7/1991 Zenger
5,054,632 A 10/1991 Alberghini et al.
5,060,453 A 10/1991 Alberghini et al.
5,067,622 A 11/1991 Garver et al.
5,090,180 A 2/1992 Sörensen
5,092,474 A 3/1992 Leigner
5,122,327 A 6/1992 Spina et al.
5,133,468 A 7/1992 Brunson et al.
5,141,121 A 8/1992 Brown et al.
5,178,290 A 1/1993 Ota et al.
5,199,587 A 4/1993 Ota et al.
5,199,588 A 4/1993 Hayashi
5,201,438 A 4/1993 Norwood
5,217,737 A 6/1993 Gygax et al.
5,234,126 A 8/1993 Jonas et al.
5,244,106 A 9/1993 Takacs
5,251,424 A 10/1993 Zenger et al.
5,255,889 A 10/1993 Collette et al.
5,261,544 A 11/1993 Weaver, Jr.
5,279,433 A 1/1994 Krishnakumar et al.
5,281,387 A 1/1994 Collette et al.
5,310,043 A 5/1994 Alcorn
5,333,761 A 8/1994 Davis et al.
5,337,909 A 8/1994 Vailliencourt
5,337,924 A 8/1994 Dickie
5,341,946 A 8/1994 Vailliencourt et al.
5,389,332 A 2/1995 Amari et al.
5,392,937 A 2/1995 Prevot et al.
5,405,015 A 4/1995 Bhatia et al.
5,407,086 A * 4/1995 Ota et al. ..... 215/383
5,411,699 A 5/1995 Collette et al.
5,454,481 A 10/1995 Hsu
5,472,105 A 12/1995 Krishnakumar et al.
5,472,181 A 12/1995 Lowell
RE35,140 E 1/1996 Powers, Jr.
5,484,052 A 1/1996 Pawloski et al.
D366,831 S 2/1996 Semersky et al.
5,492,245 A * 2/1996 Kalkanis ..... 220/609
5,503,283 A 4/1996 Semersky
5,511,966 A 4/1996 Matsui
5,543,107 A 8/1996 Malik et al.

(56) References Cited

U.S. PATENT DOCUMENTS 5,593,063 A 1/1997 Claydon et al.
5,598,941 A 2/1997 Semersky et al.
5,632,397 A 5/1997 Fandeux et al.
5,642,826 A 7/1997 Melrose
5,648,133 A * 7/1997 Suzuki et al. ..... 428/36.92
5,672,730 A 9/1997 Cottman
5,687,874 A 11/1997 Omori et al.
5,690,244 A 11/1997 Darr
5,697,489 A 12/1997 Deonarine et al.
5,704,504 A 1/1998 Bueno
5,713,480 A 2/1998 Petre et al.
5,718,030 A 2/1998 Langmack et al.
5,730,314 A 3/1998 Wiemann et al.
5,730,914 A 3/1998 Ruppman, Sr.
5,735,420 A 4/1998 Nakamaki et al.
5,737,827 A 4/1998 Kuse et al.
5,758,802 A 6/1998 Wallays
5,762,221 A 6/1998 Tobias et al.
5,780,130 A 7/1998 Hansen et al.
5,785,197 A 7/1998 Slat
5,819,507 A 10/1998 Kaneko et al.
5,829,614 A 11/1998 Collette et al.
5,860,556 A 1/1999 Robbins, III
5,887,739 A 3/1999 Prevot et al.
5,888,598 A 3/1999 Brewster et al.
5,897,090 A 4/1999 Smith et al.
5,906,286 A 5/1999 Matsuno et al.
5,908,128 A 6/1999 Krishnakumar et al.
D413,519 S 9/1999 Eberle et al.
D415,030 S 10/1999 Searle et al.
5,971,184 A 10/1999 Krishnakumar et al.
5,976,653 A 11/1999 Collette et al.
5,989,661 A 11/1999 Krishnakumar et al.
6,016,932 A 1/2000 Gaydosh et al.
RE36,639 E 4/2000 Okhai
6,045,001 A 4/2000 Seul
6,051,295 A 4/2000 Schloss et al.
6,063,325 A 5/2000 Nahill et al.
6,065,624 A 5/2000 Steinke
6,068,110 A 5/2000 Kumakiri et al.
6,074,596 A 6/2000 Jacquet
6,077,554 A 6/2000 Wiemann et al.
6,090,334 A 7/2000 Matsuno et al.
6,105,815 A 8/2000 Mazda
6,113,377 A 9/2000 Clark
D433,946 S 11/2000 Rollend et al.
6,176,382 B1 1/2001 Bazlur Rashid
D440,877 S 4/2001 Lichtman et al.
6,209,710 B1 4/2001 Mueller et al.
6,213,325 B1 4/2001 Cheng et al.
6,217,818 B1 4/2001 Collette et al.
6,228,317 B1 5/2001 Smith et al.
6,230,912 B1 5/2001 Rashid
6,248,413 B1 6/2001 Barel et al.
6,253,809 B1 7/2001 Paradies
6,273,282 B1 8/2001 Ogg et al.
6,277,321 B1 8/2001 Vailliencourt et al.
6,298,638 B1 10/2001 Bettle
D450,595 S 11/2001 Ogg et al.
6,354,427 B1 3/2002 Pickel et al.
6,375,025 B1 4/2002 Mooney
6,390,316 B1 5/2002 Mooney
6,409,035 B1 * 6/2002 Darr et al. ..... 215/373
6,413,466 B1 7/2002 Boyd et al.
6,439,413 B1 8/2002 Prevot et al.
6,460,714 B1 10/2002 Silvers et al.
6,467,639 B2 10/2002 Mooney
6,485,669 B1 11/2002 Boyd et al.
6,494,333 B2 12/2002 Sasaki et al.
6,502,369 B1 1/2003 Andison et al.
6,514,451 B1 2/2003 Boyd et al.
6,569,376 B2 * 5/2003 Wurster et al. ..... 264/523
6,585,123 B1 7/2003 Pedmo et al.
6,585,124 B2 7/2003 Boyd et al.
6,595,380 B2 7/2003 Silvers
6,612,451 B2 9/2003 Tobias et al.
6,635,217 B1 10/2003 Britton
D482,976 S 12/2003 Melrose
6,662,960 B2 12/2003 Hong et al.
6,672,470 B2 * 1/2004 Wurster et al. ..... 215/373
6,676,883 B2 1/2004 Hutchinson et al.
D492,201 S 6/2004 Pritchett et al.
6,749,075 B2 6/2004 Bourque et al.
6,749,780 B2 6/2004 Tobias
6,763,968 B1 7/2004 Boyd et al.
6,763,969 B1 7/2004 Melrose et al.
6,769,561 B2 8/2004 Futral et al.
6,779,673 B2 8/2004 Melrose et al.
6,796,450 B2 9/2004 Prevot et al.
6,896,147 B2 * 5/2005 Trude ..... 215/373
6,920,992 B2 7/2005 Lane et al.
6,923,334 B2 8/2005 Melrose et al.
6,929,138 B2 8/2005 Melrose et al.
6,932,230 B2 8/2005 Pedmo et al.
6,942,116 B2 9/2005 Lisch et al.
6,974,047 B2 12/2005 Kelley et al.
6,983,858 B2 1/2006 Slat et al.
6,997,336 B2 * 2/2006 Yourist et al. ..... 215/379
7,017,763 B2 * 3/2006 Kelley ..... 215/383
7,051,073 B1 5/2006 Dutta
7,051,889 B2 5/2006 Boukobza
7,051,890 B2 * 5/2006 Onoda et al. ..... 215/383
D522,368 S 6/2006 Darr et al.
7,073,675 B2 7/2006 Trude
7,077,279 B2 7/2006 Melrose
7,080,747 B2 7/2006 Lane et al.
D531,910 S 11/2006 Melrose
7,137,520 B1 11/2006 Melrose
7,140,505 B2 * 11/2006 Roubal et al. ..... 215/373
7,150,372 B2 12/2006 Lisch et al.
D535,884 S 1/2007 Davis et al.
7,159,374 B2 1/2007 Abercrombie, III et al.
D538,168 S 3/2007 Davis et al.
D547,664 S 7/2007 Davis et al.
7,299,941 B2 * 11/2007 McMahon et al. ..... 220/780
7,334,695 B2 2/2008 Bysick et al.
7,350,657 B2 4/2008 Eaton et al.
D572,599 S 7/2008 Melrose
7,416,089 B2 * 8/2008 Kraft et al. ..... 215/373
D576,041 S 9/2008 Melrose et al.
7,451,886 B2 11/2008 Lisch et al.
7,543,713 B2 6/2009 Trude et al.
7,552,834 B2 6/2009 Tanaka et al.
7,574,846 B2 8/2009 Sheets et al.
7,694,842 B2 4/2010 Melrose
7,726,106 B2 6/2010 Kelley et al.
7,732,035 B2 * 6/2010 Pedmo et al. ..... 428/66.3
7,735,304 B2 6/2010 Kelley et al.
7,748,551 B2 7/2010 Gatewood et al.
7,780,025 B2 * 8/2010 Simpson et al. ..... 215/376
D623,952 S 9/2010 Yourist et al.
7,799,264 B2 9/2010 Trude
7,882,971 B2 2/2011 Kelley et al.
7,900,425 B2 3/2011 Bysick et al.
7,926,243 B2 * 4/2011 Kelley et al. ..... 53/440
D637,495 S 5/2011 Gill et al.
D637,913 S 5/2011 Schlies et al.
D641,244 S * 7/2011 Bysick et al. ..... D9/502
7,980,404 B2 7/2011 Trude et al.
8,011,166 B2 9/2011 Sheets et al.
8,017,065 B2 9/2011 Trude et al.
D646,966 S 10/2011 Gill et al.
8,028,498 B2 10/2011 Melrose
8,047,388 B2 * 11/2011 Kelley et al. ..... 215/373
8,075,833 B2 12/2011 Kelley
D653,119 S 1/2012 Hunter et al.
8,096,098 B2 * 1/2012 Kelley et al. ..... 53/486
D653,550 S 2/2012 Hunter
D653,957 S 2/2012 Yourist et al.
8,162,655 B2 4/2012 Trude et al.
8,171,701 B2 * 5/2012 Kelley et al. ..... 53/127
8,205,749 B2 * 6/2012 Korpanty et al. ..... 206/508
8,235,704 B2 8/2012 Kelley
8,323,555 B2 12/2012 Trude et al.

(56) References Cited

U.S. PATENT DOCUMENTS

| | | | | |
|---|---|---|---|---|
| 2001/0035391 | A1 | 11/2001 | Young et al. | |
| 2002/0063105 | A1* | 5/2002 | Darr et al. | 215/373 |
| 2002/0074336 | A1 | 6/2002 | Silvers | |
| 2002/0096486 | A1 | 7/2002 | Bourque et al. | |
| 2002/0153343 | A1 | 10/2002 | Tobias | |
| 2002/0158038 | A1 | 10/2002 | Heisel et al. | |
| 2003/0015491 | A1 | 1/2003 | Melrose et al. | |
| 2003/0186006 | A1 | 10/2003 | Schmidt et al. | |
| 2003/0196926 | A1 | 10/2003 | Tobias et al. | |
| 2003/0205550 | A1 | 11/2003 | Prevot et al. | |
| 2003/0217947 | A1 | 11/2003 | Ishikawa et al. | |
| 2004/0000533 | A1 | 1/2004 | Kamineni et al. | |
| 2004/0016716 | A1 | 1/2004 | Melrose et al. | |
| 2004/0074864 | A1 | 4/2004 | Melrose et al. | |
| 2004/0129669 | A1 | 7/2004 | Kelley et al. | |
| 2004/0149677 | A1 | 8/2004 | Slat et al. | |
| 2004/0159626 | A1* | 8/2004 | Trude | 215/373 |
| 2004/0164045 | A1* | 8/2004 | Kelley | 215/373 |
| 2004/0173565 | A1 | 9/2004 | Semersky et al. | |
| 2004/0211746 | A1 | 10/2004 | Trude | |
| 2004/0232103 | A1* | 11/2004 | Lisch et al. | 215/374 |
| 2005/0035083 | A1 | 2/2005 | Pedmo et al. | |
| 2005/0211662 | A1 | 9/2005 | Eaton et al. | |
| 2005/0218108 | A1 | 10/2005 | Bangi et al. | |
| 2006/0006133 | A1 | 1/2006 | Lisch et al. | |
| 2006/0051541 | A1 | 3/2006 | Steele | |
| 2006/0113274 | A1* | 6/2006 | Keller et al. | 215/376 |
| 2006/0118508 | A1* | 6/2006 | Kraft et al. | 215/374 |
| 2006/0138074 | A1 | 6/2006 | Melrose | |
| 2006/0138075 | A1* | 6/2006 | Roubal et al. | 215/373 |
| 2006/0151425 | A1 | 7/2006 | Kelley et al. | |
| 2006/0231985 | A1 | 10/2006 | Kelley | |
| 2006/0243698 | A1 | 11/2006 | Melrose | |
| 2006/0255005 | A1 | 11/2006 | Melrose et al. | |
| 2006/0261031 | A1 | 11/2006 | Melrose | |
| 2007/0017892 | A1 | 1/2007 | Melrose | |
| 2007/0045222 | A1 | 3/2007 | Denner et al. | |
| 2007/0045312 | A1 | 3/2007 | Abercrombie, III et al. | |
| 2007/0051073 | A1 | 3/2007 | Kelley et al. | |
| 2007/0084821 | A1 | 4/2007 | Bysick et al. | |
| 2007/0125742 | A1 | 6/2007 | Simpson, Jr. et al. | |
| 2007/0125743 | A1 | 6/2007 | Pritchett, Jr. et al. | |
| 2007/0131644 | A1 | 6/2007 | Melrose | |
| 2007/0181403 | A1 | 8/2007 | Sheets et al. | |
| 2007/0199915 | A1 | 8/2007 | Denner et al. | |
| 2007/0199916 | A1 | 8/2007 | Denner et al. | |
| 2007/0215571 | A1 | 9/2007 | Trude | |
| 2007/0235905 | A1 | 10/2007 | Trude et al. | |
| 2008/0047964 | A1 | 2/2008 | Denner et al. | |
| 2008/0156847 | A1 | 7/2008 | Hawk et al. | |
| 2008/0257856 | A1 | 10/2008 | Melrose et al. | |
| 2009/0090728 | A1 | 4/2009 | Trude et al. | |
| 2009/0091067 | A1 | 4/2009 | Trude et al. | |
| 2009/0092720 | A1 | 4/2009 | Trude et al. | |
| 2009/0120530 | A1 | 5/2009 | Kelley et al. | |
| 2009/0134117 | A1 | 5/2009 | Mooney | |
| 2009/0159556 | A1 | 6/2009 | Patcheak et al. | |
| 2009/0202766 | A1 | 8/2009 | Beuerle et al. | |
| 2009/0242575 | A1* | 10/2009 | Kamineni et al. | 220/608 |
| 2009/0293436 | A1 | 12/2009 | Miyazaki et al. | |
| 2010/0018838 | A1 | 1/2010 | Kelley et al. | |
| 2010/0116778 | A1 | 5/2010 | Melrose | |
| 2010/0133228 | A1* | 6/2010 | Trude | 215/370 |
| 2010/0140838 | A1* | 6/2010 | Kelley et al. | 264/268 |
| 2010/0163513 | A1 | 7/2010 | Pedmo | |
| 2010/0170199 | A1* | 7/2010 | Kelley et al. | 53/440 |
| 2010/0213204 | A1 | 8/2010 | Melrose | |
| 2010/0237083 | A1 | 9/2010 | Trude et al. | |
| 2010/0270259 | A1* | 10/2010 | Russell et al. | 215/382 |
| 2010/0301058 | A1 | 12/2010 | Trude et al. | |
| 2011/0049083 | A1 | 3/2011 | Scott et al. | |
| 2011/0049084 | A1 | 3/2011 | Yourist et al. | |
| 2011/0084046 | A1 | 4/2011 | Schlies et al. | |
| 2011/0094618 | A1 | 4/2011 | Melrose | |
| 2011/0108515 | A1 | 5/2011 | Gill et al. | |
| 2011/0113731 | A1* | 5/2011 | Bysick et al. | 53/440 |
| 2011/0132865 | A1 | 6/2011 | Hunter et al. | |
| 2011/0147392 | A1 | 6/2011 | Trude et al. | |
| 2011/0210133 | A1 | 9/2011 | Melrose et al. | |
| 2011/0266293 | A1* | 11/2011 | Kelley et al. | 220/672 |
| 2011/0284493 | A1 | 11/2011 | Yourist et al. | |
| 2012/0074151 | A1* | 3/2012 | Gill et al. | 220/669 |
| 2012/0104010 | A1 | 5/2012 | Kelley | |
| 2012/0107541 | A1 | 5/2012 | Nahill et al. | |
| 2012/0118899 | A1* | 5/2012 | Wurster et al. | 220/600 |
| 2012/0132611 | A1 | 5/2012 | Trude et al. | |
| 2012/0152964 | A1 | 6/2012 | Kelley et al. | |
| 2012/0240515 | A1* | 9/2012 | Kelley et al. | 53/127 |
| 2012/0266565 | A1 | 10/2012 | Trude et al. | |
| 2012/0267381 | A1 | 10/2012 | Trude et al. | |
| 2013/0000259 | A1 | 1/2013 | Trude et al. | |

FOREIGN PATENT DOCUMENTS

| | | | |
|---|---|---|---|
| DE | 1761753 | | 1/1972 |
| DE | P2102319.8 | | 8/1972 |
| DE | 3215866 | A1 | 11/1983 |
| EP | 225 155 | A2 | 6/1987 |
| EP | 225155 | A2 | 6/1987 |
| EP | 346518 | A1 | 12/1989 |
| EP | 0 502 391 | A2 | 9/1992 |
| EP | 0 505054 | A1 | 9/1992 |
| EP | 0521642 | A1 | 1/1993 |
| EP | 0551788 | A1 | 7/1993 |
| EP | 0572722 | A1 | 12/1993 |
| EP | 0666222 | A1 | 2/1994 |
| EP | 0 739 703 | | 10/1996 |
| EP | 0521624 | B1 | 12/1996 |
| EP | 0609348 | B1 | 2/1997 |
| EP | 0916406 | A2 | 5/1999 |
| EP | 0957030 | A2 | 11/1999 |
| EP | 1063076 | A1 | 12/2000 |
| EP | 2248728 | A1 | 11/2010 |
| FR | 1571499 | | 6/1969 |
| FR | 2607109 | | 5/1988 |
| FR | 2919579 | A1 | 2/2009 |
| GB | 781103 | | 8/1957 |
| GB | 1113988 | | 5/1968 |
| GB | 2050919 | A | 1/1981 |
| GB | 2372977 | A | 9/2002 |
| JP | S40-15909 | | 6/1940 |
| JP | 48-31050 | | 9/1973 |
| JP | 49-28628 | | 7/1974 |
| JP | 54-72181 | A | 6/1979 |
| JP | 35656830 | A | 5/1981 |
| JP | S56-62911 | | 5/1981 |
| JP | 56-72730 | U | 6/1981 |
| JP | 54-070185 | | 1/1982 |
| JP | 57-210829 | A | 1/1982 |
| JP | 57-37827 | | 2/1982 |
| JP | 57-37827 | U | 2/1982 |
| JP | 57-0177730 | | 2/1982 |
| JP | 57-126310 | | 8/1982 |
| JP | 58-055005 | | 4/1983 |
| JP | 61-192539 | A | 8/1986 |
| JP | 63-189224 | A | 8/1988 |
| JP | 57-126310 | | 2/1989 |
| JP | 64-004662 | | 2/1989 |
| JP | 3-43342 | | 2/1991 |
| JP | 3-43342 | A | 2/1991 |
| JP | 03-076625 | A | 4/1991 |
| JP | 4-10012 | | 1/1992 |
| JP | 5-193694 | | 8/1993 |
| JP | 53-10239 | A | 11/1993 |
| JP | H05-81009 | | 11/1993 |
| JP | 06-270235 | A | 9/1994 |
| JP | 6-336238 | A | 12/1994 |
| JP | 07-300121 | A | 11/1995 |
| JP | H08-048322 | | 2/1996 |
| JP | 08-244747 | A | 9/1996 |
| JP | 8-253220 | A | 10/1996 |
| JP | 282633 | A | 10/1996 |
| JP | 09-039934 | A | 2/1997 |
| JP | 9-110045 | A | 4/1997 |

(56) References Cited

FOREIGN PATENT DOCUMENTS

| | | | |
|---|---|---|---|
| JP | 10-167226 | A | 6/1998 |
| JP | 10-181734 | A | 7/1998 |
| JP | 10-230919 | A | 9/1998 |
| JP | 3056271 | | 11/1998 |
| JP | 11-218537 | A | 8/1999 |
| JP | 2000-229615 | | 8/2000 |
| JP | 2002-127237 | A | 5/2002 |
| JP | 2002-160717 | A | 6/2002 |
| JP | 2002-326618 | A | 11/2002 |
| JP | 2003-095238 | | 4/2003 |
| JP | 2004-026307 | A | 1/2004 |
| JP | 2006-501109 | | 1/2006 |
| JP | 2007-216981 | A | 8/2007 |
| JP | 2008-189721 | A | 8/2008 |
| JP | 2009-001639 | A | 1/2009 |
| NZ | 240448 | | 6/1995 |
| NZ | 296014 | | 10/1998 |
| NZ | 335565 | | 10/1999 |
| NZ | 506684 | | 9/2001 |
| NZ | 512423 | | 9/2001 |
| NZ | 521694 | | 10/2003 |
| WO | WO 93/09031 | A1 | 5/1993 |
| WO | WO 93/12975 | A1 | 7/1993 |
| WO | WO 94/05555 | | 3/1994 |
| WO | WO 94/06617 | | 3/1994 |
| WO | WO 97/03885 | | 2/1997 |
| WO | WO 97/14617 | | 4/1997 |
| WO | WO 97/34808 | | 9/1997 |
| WO | WO 97/34808 | A1 | 9/1997 |
| WO | WO 99/21770 | | 5/1999 |
| WO | WO 00/38902 | A1 | 7/2000 |
| WO | WO 00/51895 | A1 | 9/2000 |
| WO | WO 01/12531 | A1 | 2/2001 |
| WO | WO 01/40081 | A1 | 6/2001 |
| WO | WO 01/74689 | A1 | 10/2001 |
| WO | WO 02/02418 | A1 | 1/2002 |
| WO | WO 02/18213 | A1 | 3/2002 |
| WO | WO 02/085755 | A1 | 10/2002 |
| WO | WO 2004/028910 | A1 | 4/2004 |
| WO | WO 2004/106176 | A2 | 9/2004 |
| WO | WO 2004/106175 | A1 | 12/2004 |
| WO | WO 2005/012091 | A2 | 2/2005 |
| WO | WO 2005/025999 | A1 | 3/2005 |
| WO | WO 2005/087628 | A1 | 9/2005 |
| WO | WO 2006/113428 | A2 | 10/2006 |
| WO | WO 2007/047574 | A1 | 4/2007 |
| WO | WO 2007/127337 | A2 | 11/2007 |
| WO | WO 2010/058098 | A2 | 5/2010 |

OTHER PUBLICATIONS

IPRP (including Written Opinion) for PCT/US2006/040361 dated Apr. 16, 2008.
International Search Report for PCT/US2004/016405 dated Feb. 15, 2005.
IPRP (including Written Opinion) for PCT/US2004/016405 dated Nov. 25, 2005.
"Application and Development of PET Plastic Bottle," Publication of Tsinghad Tongfang Optical Disc Co. Ltd., Issue 4, 2000, p. 41. (No English language translation available).
Manas Chanda & Salil K. Roy, Plastics Technology Handbook, Fourth Edition, 2007 CRC Press, Taylor & Francis Group, pp. 2-34-2-37.
U.S. Appl. No. 13/251,966, filed Oct. 3, 2011, Howell et al.
U.S. Appl. No. 13/210,358, filed Aug. 15, 2011, Wurster et al.
U.S. Appl. No. 13/410,902, filed Mar. 2, 2012, Gill.
U.S. Appl. No. 60/220,326, filed Jul. 24, 2000 dated Oct. 29, 2008.
International Search Report for PCT/US2005/008374 dated Aug. 2, 2005.
IPRP (including Written Opinion) for PCT/US2005/008374 dated Sep. 13, 2006.
Office Action for Application No. EP 06 750 165.0-2307 dated Nov. 24, 2008.
International Search Report and Written Opinion for PCT/US2007/006318 dated Sep. 11, 2007.
IRRP (including Written Opinion) for PCT/US2007/006318 dated Sep. 16, 2008.
International Search Report for PCT/US2006/014055 dated Aug. 24, 2006.
IPRP (including Written Opinion) PCT/US2006/014055 dated Oct. 16, 2007.
International Search Report for PCT/US2004/024581 dated Jul. 25, 2005.
IPRP (including Written Opinion) for PCT/US2004/024581 dated Jan. 30, 2006.
International Search Report and Written Opinion dated Mar. 15, 2010 for PCT/US2010/020045.
Official Notification for counterpart Japanese Application No. 2006-522084 dated May 19, 2009.
Examination Report for counterpart New Zealand Application No. 545528 dated Jul. 1, 2008.
Examination Report for counterpart New Zealand Application No. 569422 dated Jul. 1, 2008.
Examination Report for New Zealand Application No. 550336 dated Mar. 26, 2009.
Examination Report for counterpart New Zealand Application No. 545528 dated Sep. 20, 2007.
Examination Report for counterpart New Zealand Application No. 569422 dated Sep. 29, 2009.
Office Action for Chinese Application No. 2006800380748 dated Jul. 10, 2009.
Examiner's Report for Australian Application No. 2006236674 dated Sep. 18, 2009.
Examiner's Report for Australian Application No. 2006236674 dated Nov. 6, 2009.
Office Action for Chinese Application No. 200680012360.7 dated Jul. 10, 2009.
Examination Report for New Zealand Application No. 563134 dated Aug. 3, 2009.
Office Action for European Application No. 07752979.0-2307 dated Aug. 21, 2009.
International Search Report for PCT/US2006/014055 dated Dec. 7, 2006.
International Search Report and Written Opinion dated Sep. 8, 2009 for PCT/US2009/051023.
Office Action dated Feb. 3, 2010 for Canadian Application No. 2,604,231.
Communication dated Mar. 9, 2010 for European Application No. 09 173 607.4 enclosing European search report and European search opinion dated Feb. 25, 2010.
European Search Report for EPA 10185697.9 dated Mar. 21, 2011.
International Search report dated Apr. 21, 2010 from corresponding PCT/US2009/066191 filed Dec. 1, 2009.
International Preliminary Report on Patentability and Written Opinion dated Jun. 14, 2011 for PCT/US2009/066191. 7 pages.
Office Action, Japanese Application No. 2008-506738 dated Aug. 23, 2011.
Extended European Search Report for EPA 10185697.9 dated Jul. 6, 2011.
Patent Abstracts of Japan, vol. 012, No. 464; Dec. 6, 1988.
Patent Abstracts of Japan, vol. 2002, No. 09, Sep. 4, 2002.
Patent Abstracts of Japan, vol. 015, No. 239, Jun. 20, 1991.
Examination Report dated Jul. 25, 2012, in New Zealand Patent Application No. 593486.
Taiwanese Office Action dated Jun. 10, 2012, Application No. 095113450.
Japanese First Notice of Reasons for Rejection dated Aug. 23, 2011, in Application No. 2008-506738.
Japanese Second Notice of Reasons for Rejection dated Jun. 11, 2012, in Application No. 2008-506738.
Office Action dated Aug. 14, 2012, in Japanese Patent Application No. 2008-535769.
Examiner's Report dated Feb. 15, 2011 in Australian Application No. AU200630483.
Office Action dated Oct. 31, 2011, in Australian Patent Application No. 2011203263.

(56) References Cited

OTHER PUBLICATIONS

Office Action dated Jul. 19, 2011, in Japanese Patent Application No. 2008-535769.
Office Action dated Dec. 6, 2011, in Japanese Patent Application No. 2008-535769.
International Search Report and Written Opinion for PCT/US2012/050251 dated Nov. 16, 2012.
International Search Report and Written Opinion for PCT/US2012/050256 dated Dec. 6, 2012.
Requisition dated Feb. 3, 2010 for Canadian Application No. 2,604,231.
Requisition dated Jan. 9, 2013 for Canadian Application No. 2,559,319.
Office Action dated Feb. 5, 2013, in Mexican Patent Application No. MX/a/2008/004703.
Office Action dated Jul. 26, 2010 for Canadian Application No. 2,527,001.
Australian Office Action dated Mar. 3, 2011 in Application No. 2010246525.
Australian Office Action dated Nov. 8, 2011, in Application No. 2011205106.
Examiner Report dated May 26, 2010, in Australian Application No. 2004261654.
Examiner Report dated Jul. 23, 2010, in Australian Application No. 2004261654.
Requisition dated May 25, 2010 for Canadian Application No. 2,534,266.
Communication dated Jun. 16, 2006, for European Application No. 04779595.0.
Final Official Notification dated Mar. 23, 2010 for Japanese Application No. 2006-522084.
International Search Report and Written Opinion dated Dec. 18, 2012, in PCT/US12/056330.
U.S. Appl. No. 12/770,824, filed Feb. 19, 2013, Trude.
U.S. Appl. No. 13/841,566, filed Mar. 15, 2013, Guerin.
U.S. Appl. No. 13/841,734, filed Mar. 15, 2013, Guerin.
Trial Decision dated Mar. 26, 2013, in Japanese Patent Application No. 2008-835739.
European Extended Search Report dated Feb. 20, 2015 in EP 12 82 3438.

* cited by examiner

PLASTIC CONTAINERS HAVING BASE CONFIGURATIONS WITH UP-STAND WALLS HAVING A PLURALITY OF RINGS, AND SYSTEMS, METHODS, AND BASE MOLDS THEREOF

FIELD

The disclosed subject matter relates to base configurations for plastic containers, and systems, methods, and base molds thereof. In particular, the disclosed subject matter involves base configurations having particular up-stand geometries that can assist or facilitate elevated temperature processing and/or cooling processing of plastic containers.

SUMMARY

The Summary describes and identifies features of some embodiments. It is presented as a convenient summary of some embodiments, but not all. Further the Summary does not necessarily identify critical or essential features of the embodiments, inventions, or claims.

According to embodiments, a plastic container comprises: a sidewall configured to receive a label; a finish projecting from an upper end of said sidewall, said finish operative to receive a closure; and a base below said sidewall. The base has a bottom end that includes: a bearing portion defining a standing surface for plastic container; an up-stand geometry wall of a stacked configuration extending upward from said bearing portion; and an inner wall circumscribed by said up-stand geometry wall in end view of the plastic container, said inner wall and said up-stand geometry wall being cooperatively operative so as to accommodate pressure variation within the container after the container has been filled with a product and sealed with the closure, said inner wall being operative to flex in response to the pressure variation within the container after the container has been hot-filled and sealed with the closure, whereas said up-stand geometry wall is operative to withstand movement as said inner wall flexes in response to the pressure variation within the container after the container has been hot-filled and sealed with the closure.

Also included among embodiments described herein is a method comprising: providing a blow-molded plastic container, the plastic container including a sidewall configured to support a film label, a finish projecting from an upper end of the sidewall and operative to cooperatively receive a closure to sealingly enclose the plastic container, and a base extending from the sidewall to form a bottom enclosed end of the plastic container, wherein the bottom end has a standing ring upon which the container may rest, a rigid wall comprised of a plurality of stacked rings extending upward from the standing ring, and a movable wall extending inward from the rigid wall toward a central longitudinal axis of the container. The method also comprises hot-filling the plastic container via the finish with a product; sealing the hot-filled plastic container with the closure; cooling the hot-filled and sealed plastic container; and compensating for an internal pressure characteristic after hot-filling and sealing the plastic container, said compensating including substantially no movement of the rigid wall.

Embodiments also include a hot-fillable, blow-molded plastic wide-mouth jar configured to be filled with a viscous food product at a temperature from 185° F. to 205° F., which comprises: a cylindrical sidewall configured to support a wrap-around label; a wide-mouth threaded finish projecting from an upper end of said sidewall via a shoulder, said threaded finish operative to receive a closure, and said shoulder defining an upper label stop above said sidewall; and a base defining a lower label stop below said sidewall. The base has a bottom end that includes: a bearing portion defining a standing surface for the jar, the base being smooth and without surface features from said bearing portion to said lower label stop; an up-stand geometry wall of a stacked three-ring configuration circumscribed by said bearing portion and extending generally upward and radially inward from said bearing portion, a first ring of the stack being the bottom ring of the stack and having a first diameter, a second ring of the stack being the middle ring of the stack and having a second diameter and a third ring of the stack being the top ring and having a third diameter, the first diameter being greater than the second and third diameters, and the second diameter being greater than the third diameter. The bottom end of the base also includes an inner wall circumscribed by said up-stand geometry wall, said inner wall and said up-stand geometry wall are cooperatively operative so as to accommodate pressure variation within the jar after the jar has been hot-filled with the product at the temperature from 185° F. to 205° F. and sealed with the closure, said inner wall being operative to flex in response to the pressure variation within the jar after the jar has been hot-filled and sealed with the closure, whereas said up-stand geometry wall is operative to withstand movement as said inner wall flexes in response to the pressure variation within the jar after the jar has been hot-filled and sealed with the lid.

Embodiments also include a plastic container comprising: a sidewall configured to receive a label; a finish projecting from an upper end of said sidewall, said finish operative to receive a closure; and a base below said sidewall. The base has a bottom end that includes: a bearing portion defining a standing surface for plastic container; an up-stand geometry wall of a stacked configuration extending upward from said bearing portion; and an inner wall circumscribed by said up-stand geometry wall in end view of the plastic container, said inner wall and said up-stand geometry wall being cooperatively operative so as to accommodate pressure variation within the container after the container has been filled with a product and sealed with the closure, said inner wall being operative to flex in response to the pressure variation within the container after the container has been hot-filled and sealed with the closure, whereas said up-stand geometry wall is operative to withstand movement as said inner wall flexes in response to the pressure variation within the container after the container has been hot-filled and sealed with the closure. Optionally, the stacked configuration of the up-stand geometry wall includes a plurality of stacked rings, the rings all having a same circumference. Optionally, the stacked configuration of the up-stand geometry wall includes a plurality of stacked rings, the rings each having a different circumference.

In embodiments, a base mold to form a bottom end portion of a base of a plastic wide-mouth jar, the bottom end portion of the plastic jar having a bottom bearing surface of the jar, a rigid ringed wall extending upward from the bottom bearing surface and an inner flexible wall arranged inwardly of the ringed wall, wherein the base mold comprises: a body portion; a bearing surface forming portion to form a portion of the bottom bearing surface; a ringed wall forming portion to form the rigid ringed wall; a lip portion to form a ridge of the bottom end portion; and an inner flexible wall forming portion to form the inner flexible wall. The ringed wall forming portion may be comprised of a stack of three ring protrusions to form the rigid ringed wall, respective maximum diameters of the ring protrusions decreasing in value from the bottom of the stack to the top of the stack. Optionally, the inner flexible wall forming portion can include an upwardly protruding gate portion. Optionally, the base mold further can includes a ridge forming portion between said ringed wall forming portion and said inner flexible wall forming portion to form a ridge.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Any values dimensions illustrated in the accompanying graphs and figures are for illustration purposes only and may not represent actual or preferred values or dimensions. Where applicable, some features may not be illustrated to assist in the description of underlying features.

DETAILED DESCRIPTION

Figure 1:
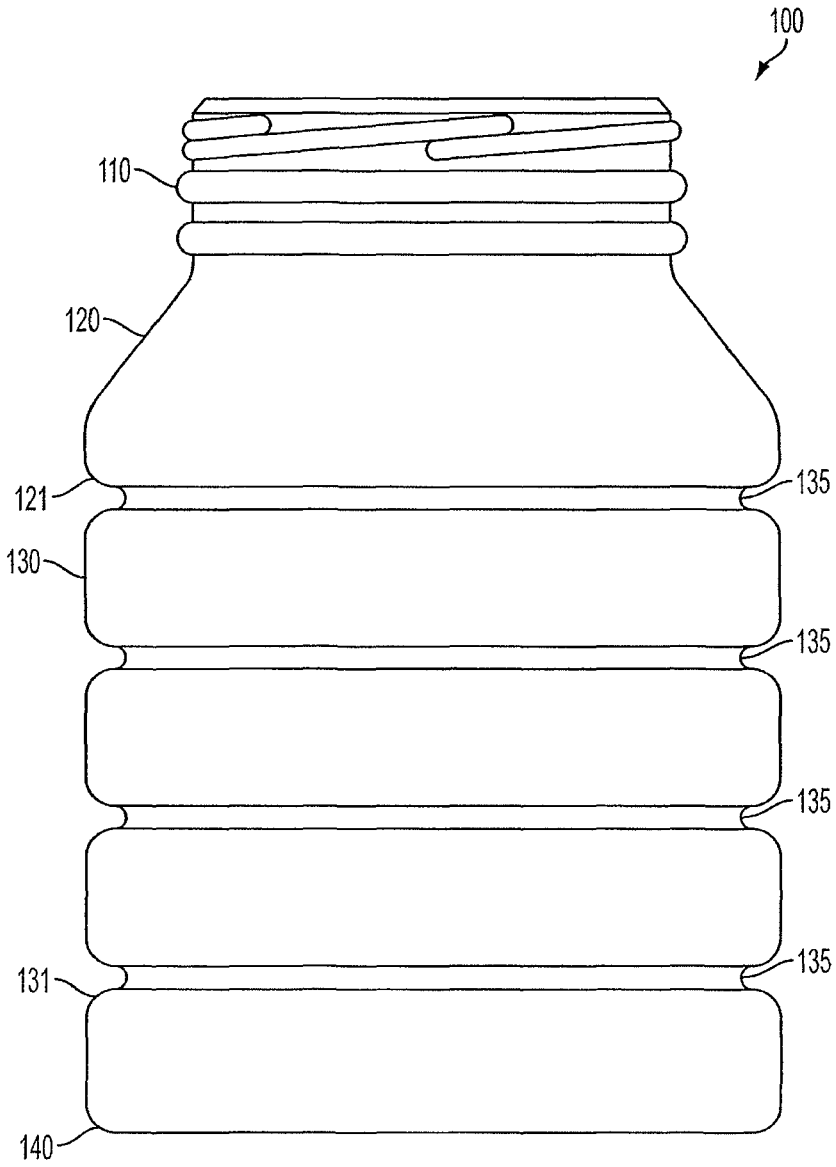
FIG. 1 is a side view of a plastic container according to embodiments of the disclosed subject matter.

The detailed description set forth below in connection with the appended drawings is intended as a description of various embodiments of the disclosed subject matter and is not intended to represent the only embodiments in which the disclosed subject matter may be practiced. The detailed description includes specific details for the purpose of providing a thorough understanding of the disclosed subject matter. However, it will be apparent to those skilled in the art that the disclosed subject matter may be practiced without these specific details. In some instances, well-known structures and components may be shown in block diagram form in order to avoid obscuring the concepts of the disclosed subject matter.

The disclosed subject matter relates to base configurations for plastic containers, and systems, methods, and base molds thereof. In particular, the disclosed subject matter involves base configurations having particular up-stand geometries that assist or facilitate elevated temperature processing, such as hot-filling, pasteurization, and/or retort processing. Optionally, plastic containers according to embodiments of the disclosed subject matter also may be configured and operative to accommodate internal forces caused by post elevated temperature processing, such as temperature-induced forces from varying temperatures in transit to or in storage at a distributor (e.g., wholesale or retail vendor), for example, prolonged effects of the weight of the product stored therein over time, etc., and/or cooling operations (including exposure to ambient temperature) after or between elevated temperature processing.

Generally speaking, in various embodiments, plastic containers according to embodiments of the disclosed subject matter have a base portion with a bottom end having an up-stand wall of a particular geometry. The up-stand wall can resist movement in response to pressure variations or forces within the container and can facilitate movement or otherwise work in conjunction with a movable portion of the bottom end of the container base.

Thus, while an up-stand wall remains stationary or substantially stationary, a bottom end portion of the container can move in response to internal pressures within the container when hot-filled and sealed, for instance. Optionally, the bottom end portion may be constructed and operative to move downwardly and axially outward in response to internal pressures, such as headspace pressure or under the weight of the product, and also to move upwardly and axially inward in response to a different internal pressure, such as an internal vacuum created within the container due to cooling or cooling processing of the container. Alternatively, the bottom end portion may be constructed and operative to resist movement in one direction, for example, a downward and axially outward direction, in response to internal pressures (e.g., headspace pressure, product weight, etc.), but may be constructed and operative to move upward and axially inward in response to a different internal pressure, such as an internal vacuum created within the container due to cooling or cooling processing of the container.

Meanwhile, the up-stand wall may extend from the standing or support portion of the container vertically or substantially vertically, angling or sloping radially inward. The up-stand wall can be constructed and operative to remain stationary during movement of the movable bottom end portion of the container. Optionally, the up-stand wall may be constructed and operative to move or flex radially inward slightly during movement of the movable bottom end portion. Optionally, the up-stand wall may be constructed and operative to move or flex radially outward during movement of the movable bottom end portion. In the case of jars, for example, the up-stand wall can remain rigid or stationary in response to relatively higher temperatures and pressures typically involved in jar applications.

In various embodiments, the up-stand geometry can be of a stacked ring or rib configuration. Any suitable number of rings or ribs can be stacked, such as two, three, four, or five. The rings can be stacked directly vertically on top of one another, or may taper inward with each successive ring. Alternatively, only one ring may be implemented. Such use of up-stand geometry, and in particular, stacked ring configurations according to embodiments of the disclosed subject matter may provide the ability to use less material to form a jar, for instance, while providing desired container characteristics, such as the container's ability to compensate for internal pressure variations within the container after hot filling and sealing.

Plastic containers according to embodiments of the disclosed subject matter can be of any suitable configuration. For example, embodiments may include jars, such as wide-mouth jars, and base configurations thereof. Embodiments may also include single serve containers, bottles, jugs, asymmetrical containers, or the like, and base configurations thereof. Thus, embodiments of the disclosed subject matter can be filled with and contain any suitable product including a fluent, semi-fluent, or viscous food product, such as applesauce, spaghetti sauce, relishes, baby foods, brine, jelly, and the like, or a non-food product such as water, tea, juice, isotonic drinks or the like.

Plastic containers according to embodiments of the disclosed subject matter can be of any suitable size. For example, embodiments include containers with internal volumes of 24 oz., 45 oz., 48 oz., or 66 oz. Also, container sizes can include single-serving and multiple-serving size containers. Further, embodiments can also include containers with mouth diameters of 38 mm, 55 mm or higher, for instance.

Hot-fill processing can include filling a product into the container at any temperature in a range of at or about 130° F. to at or about 205° F. or in a range of at or about 185° F. to at or about 205° F. For example, a wide-mouth jar can be filled with a hot product at a temperature of at or about 205° F. Optionally, the hot-fill temperature can be above 205° F., such as 208° F. As another example, a single-serve container, such as for an isotonic, can be filled with a hot product at a temperature of 185° F. or slightly below.

Plastic containers according to embodiments of the disclosed subject matter can be capped or sealed using any suitable closure, such as a plastic or metallic threaded cap or lid, a foil seal, a lug closure, a plastic or metallic snap-fit lid or cap, etc.

Plastic containers according to embodiments of the disclosed subject matter can also optionally be subjected to through processing, such as pasteurization and/or retort processing.

Pasteurization can involve heating a filled and sealed container and/or the product therein to any temperature in the range of at or about 200° F. to at or about 215° F. or at or about 218° F. for any time period at or about five minutes to at or about forty minutes, for instance. In various embodiments, a hot rain spray may be used to heat the container and its contents.

Retort processing for food products, for instance, can involve heating a filled and sealed container and/or the product therein to any temperature in the range of at or about 230° F. to at or about 270° F. for any time period at or about twenty minutes to at or about forty minutes, for instance. Overpressure also may be applied to the container by any suitable means, such as a pressure chamber.

FIG. 1 is a side view of a plastic container in the form of a blow-molded plastic wide-mouth jar 100 according to embodiments of the disclosed subject matter. Jar 100 is shown in FIG. 1 in its empty condition, after blow-molding, but before hot-filling and sealing with a closure, and in the absence of any internal or external applied forces.

Jar 100 can be configured and operative to undergo elevated temperature processing, such as hot-filling, pasteurization, and/or retort processing. For example, jar 100 may receive a food product as described herein at an elevated temperature as described herein, such as at a temperature from 185° F. to 205° F. Jar 100 also can be constructed and operative to undergo cooling processing or cool-down operations. Jar 100 is further constructed and operative to accommodate or react in a certain manner to any of the aforementioned forces or pressures. Jar 100 also may be subjected to forces caused by post hot-fill and cooling operations, such as temperature-induced forces from varying temperatures in transit to or in storage at a distributor (e.g., wholesale or retail vendor), prolonged effects of the weight of the product stored therein over time, etc.

Jar 100 can include tubular sidewall 130, a threaded finish 110 operative to receive a threaded closure (e.g., a lid), a shoulder or dome 120, and a base 140. As indicated earlier, threaded finish 110 can be a wide-mouth finish and may be of any suitable dimension. For instance, the wide-mouth finish may have a diameter of 55 mm. Of course finishes and corresponding enclosures other than those that are threaded may be implemented. Jar 100 also may have upper and lower label bumpers or stops 121, 131. Label bumpers may define a label area between which a label, such as a wrap-around label, can be affixed to sidewall 130. Optionally, sidewall 130 may include a plurality of concentric ribs 135, circumscribing the sidewall 130 horizontally. Ribs 135 may be provided to reinforce the sidewall 130 and resist paneling, denting, barreling, ovalization, and/or other unwanted deformation of the sidewall 130, for example, in response to hot-filling, pasteurization, and/or retort processing. Not explicitly shown, one or more supplemental vacuum panels may be located on the dome 120 in order to prevent unwanted deformation of sidewall 130, for instance. Thus, the one or more supplemental vacuum panels may take up a portion of in induced vacuum caused by cooling a filled and sealed jar 100, and, as will be discussed in more detail below, an inner wall may flex or move to take up or remove a second portion of the induced vacuum.

Figure 2:
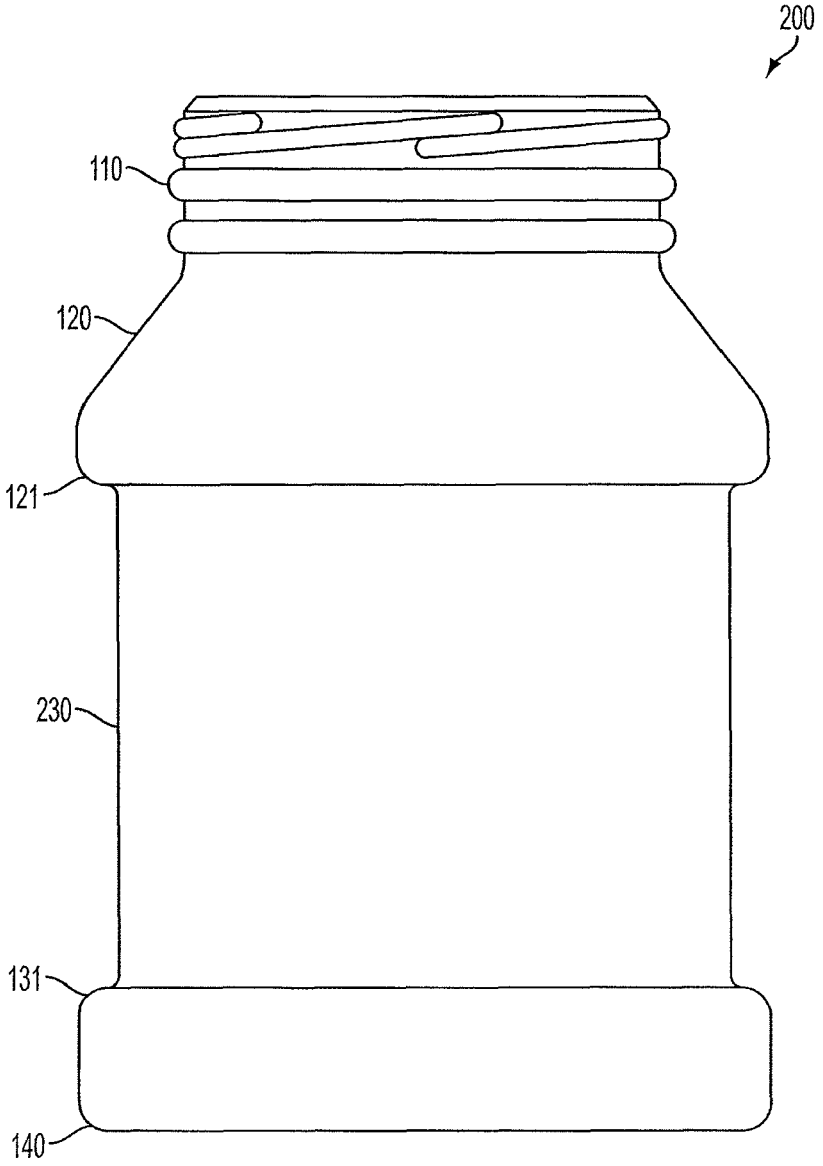
FIG. 2 is a side view of another plastic container according to embodiments of the disclosed subject matter.

FIG. 2 is a side view of another plastic container in the form of a jar 200 according to embodiments of the disclosed subject matter. As can be seen, jar 200 is similar to jar 100, but without ribs 135 in its sidewall 230. Upper and lower label bumpers or stops 121, 131 are shown more pronounced in FIG. 2, however, their dimensions in relation to sidewall 230 may be similar to or the same as shown in the jar 100 of FIG. 1. Additionally, jar 200 also may include one or more supplemental vacuum panels. Such one or more supplemental vacuum panels may be located on the dome 120 and/or in the sidewall 230 and/or between bumper stop 131 and the bottom standing support formed by the base 140. Accordingly, as with the one or more supplemental vacuum panels mentioned above for jar 100, the one or more supplemental vacuum panels may take up a portion of in induced vacuum caused by cooling a filled and sealed jar 200, and an inner wall may flex or move inward into the jar 200 to take up or remove a second portion of the induced vacuum.

Figure 3A:
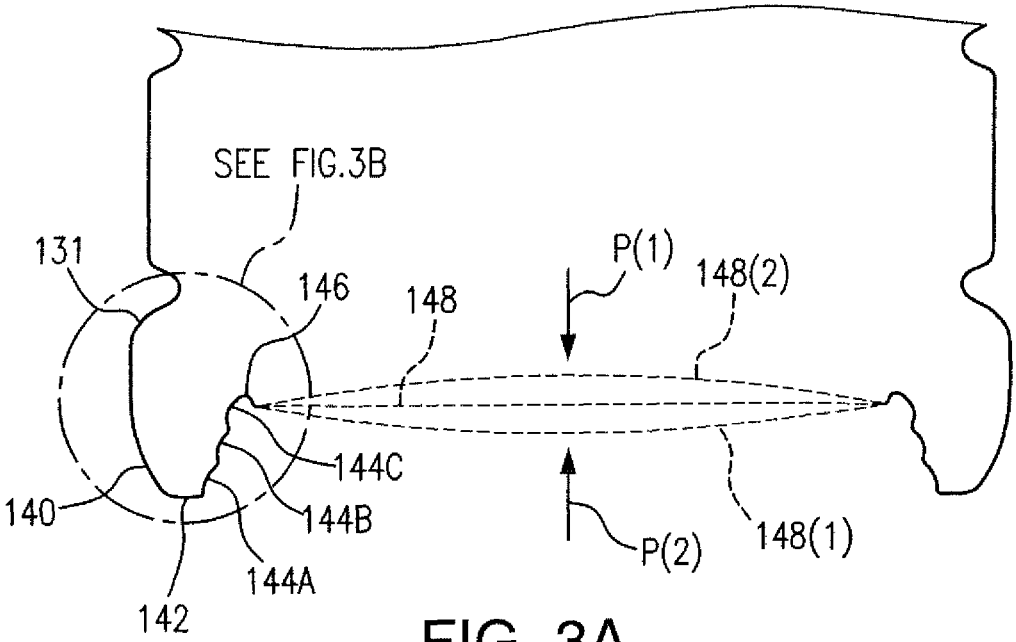
FIG. 3A is a cross section view of a base portion of a container according to embodiments of the disclosed subject matter.
Figure 3B:
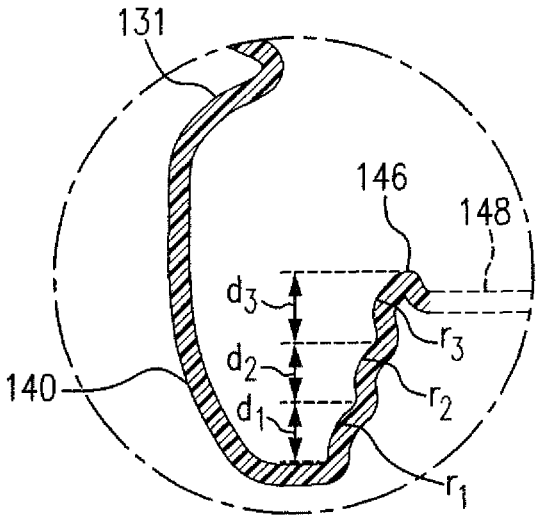
FIG. 3B is a magnified view of the circled portion of the base portion of FIG. 3A.
Figure 3C:
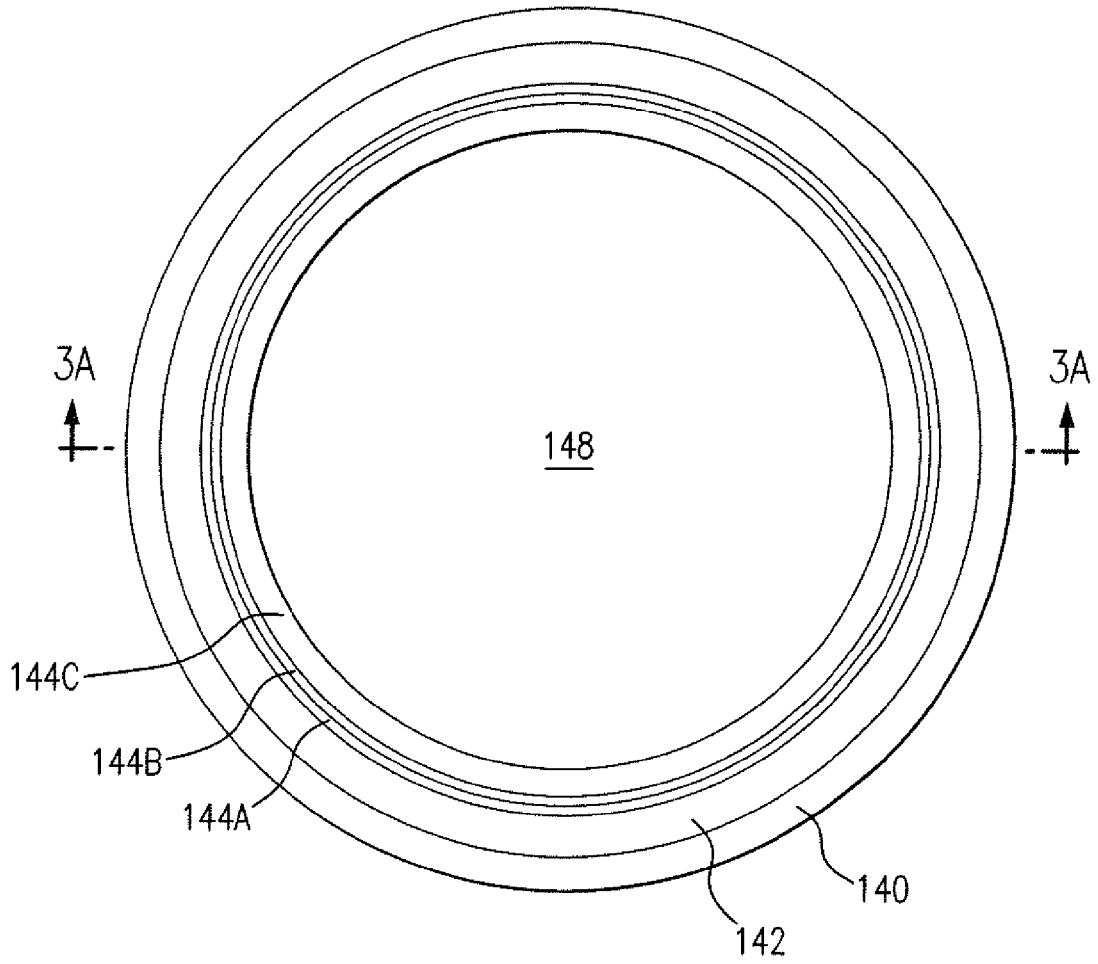
FIG. 3C is a bottom end view of the base portion of FIG. 3A.

FIGS. 3A-3C show views of base 140 and in particular a bottom end thereof, with FIG. 3A being a cross section view of base 140, FIG. 3B being a magnified view of the circled portion of FIG. 3A, and FIG. 3C being a bottom end view of base 140.

Generally speaking, the bottom end of the base 140 is constructed and operative to be responsive to elevated temperature processing, such as during and after hot-filling and sealing and optionally during pasteurization and/or retort processing. The bottom end may also be subjected to forces caused by post hot-fill and cooling operations, such as temperature-induced forces from varying temperatures in transit to or in storage at a distributor (e.g., wholesale or retail vendor), prolonged effects of the weight of the product stored therein over time, etc., and can accommodate such forces, such as by preventing a portion of the bottom end from setting and/or moving to a non-recoverable position. As indicated above, an up-stand wall is constructed and operative to remain stationary or substantially stationary in response to elevated temperature processing and associated movement a movable bottom end portion of the container.

The bottom end of base 140 includes a bearing portion 142, for example, a standing ring that can define a bearing or standing surface of the jar. Optionally, the base 140 can be smooth and without surface features from bearing portion 142 to lower label bumper or stop 131.

The bottom end of base 140 can also include an up-stand geometric wall 144 of a stacked three-ring configuration circumscribed by the bearing portion 142. As can be seen, up-stand wall 144 can extend generally upward and radially inward from the bearing portion 142. However, alternatively, in various embodiments, up-stand wall 144 may extend only axially upward without extending radially inward. As yet another option, up-stand wall 144 may extend axially upward and slightly radially outward.

In embodiments, up-stand wall 144 can include a plurality of rings. FIGS. 3A-C show three rings, 144A, 144B, and 144C, for example. Ring 144A can have a first diameter or circumference, ring 144B can have a second diameter or circumference, and ring 144C can have a third diameter or circumference, wherein the first diameter (or circumference) can be greater than the second and third diameters (or circumferences), and the second diameter (or circumference) can be greater than the third diameter (or circumference). See in particular FIG. 3C. As will be discussed later, embodiments of the disclosed subject matter are not limited to three rings. Further, embodiments are not limited to rings all having different diameters or circumferences. Thus, in various embodiments, none of the rings may have the same diameters or circumferences, or, alternatively, only some of the rings may have the same or different diameters or circumferences. In yet another embodiment, all of the rings may have the same diameter or circumference.

Rings 144A, 144B, and 144C can have same or different amounts of vertical extension, d1, d2, d3. Thus, some or all of the rings 144A, 144B, 144C can have a same vertical extension dy, and/or some or all of the rings 144A, 144B, 144C can have a same radius of curvature. Optionally, none of the rings 144A, 144B, 144C can have a same vertical extension dy and/or a same radius of curvature. Similarly, rings 144A, 144B, and 144C can have the same or different amounts of horizontal extension radially inward dx. In FIG. 3B, for instance, rings 144A and 144B have the same horizontal extension radially inward and ring 144C extends in the x direction more than does either of rings 144A or 144B. Further, rings 144A, 144B, and 144C can have same or different radii of curvatures.

In various embodiments, up-stand wall 144 can extend from bearing portion 142 axially upward to an apex thereof. Thus, at an uppermost portion of a top ring (ring 144C in the case of the embodiment shown in FIGS. 3A-3C) may exist a ridge 146. Ridge 146 can be at a junction between up-stand wall 144 and an inner wall 148. As shown in FIG. 3A, the apex of up-stand wall 144 can be a ridge or rim 146 that is circular in end view of the jar. From the top of ridge 146, there may be a relatively sharp drop off to an inner wall 148. Alternatively, there may be no ridge and the top of the up-stand wall 144, and the up-stand wall 144 can transition gradually horizontally, tangentially, or at a subtle radius downward or upward to inner wall 148. In the case of no ridge or ridge 146, in various embodiments, the inner wall 148 may extend horizontally, downward (e.g., by an angle), or at a subtle radius downward or upward. Thus, inner wall 148 can be formed at a decline (ridge 146 or no ridge) with respect to horizontal, represented by an angle. The angle can be any suitable angle. In various embodiments, the angle can be 3°, 8°, 10° any angle from 3° to 12°, from 3° to 14°, from 8° to 12°, or from 8° to 14°. Alternatively, as indicated above, inner wall 148 may not be at an angle, and may horizontally extend, or, inner wall 148 may be at an incline with respect to horizontal in its as-formed state.

Inner wall 148 can be of any suitable configuration and can move as described herein. In various embodiments, inner wall 148 can be as set forth in U.S. application Ser. No. 13/210,358 filed on Aug. 15, 2011, the entire content of which is hereby incorporated by reference into the present application.

Inner wall 148 can be circumscribed by the up-stand wall 144, and the inner wall 148 and up-stand wall 144 can be cooperatively operative so as to accommodate pressure variation within the jar after the jar has been hot-filled with a product at a filling temperature as described herein and sealed with an enclosure (e.g., a threaded lid).

The straight, "middle" dashed line in FIG. 3A indicates that inner wall 148 can be of any suitable configuration, with more specific examples being provided later. In various embodiments, the inner wall 148 can flex in response to the pressure variation within the jar after the jar has been hot-filled with a product at a filling temperature as described herein and sealed with an enclosure. For instance, inner wall 148 may flex downward as shown by dashed line 148(1) in response to an internal pressure P(1). Internal pressure P(1) may be caused by elevated temperature of a hot product being filled into the jar and then the jar being sealed, for example (i.e., headspace pressure). Internal pressure P(1) also may be caused by elevated temperature of a product upon pasteurization or retort processing at an elevated temperature. Optionally, inner wall 148 can be constructed so that it is at or above a horizontal plane running through the bearing surface at all times during the downward flexing of the inner wall 148.

Optionally or alternatively, inner wall 148 may flex upward as shown by dashed line 148(2) in response to an internal pressure P(2), which is shown outside the jar, but can be representative of a force caused by an internal vacuum created by cooling a hot-filled product. Up-stand wall 144 is configured and operative to withstand or substantially withstand movement as the inner wall 148 flexes in response to the pressure variation within the jar after the jar has been hot-filled and sealed with the lid.

Figure 4A:
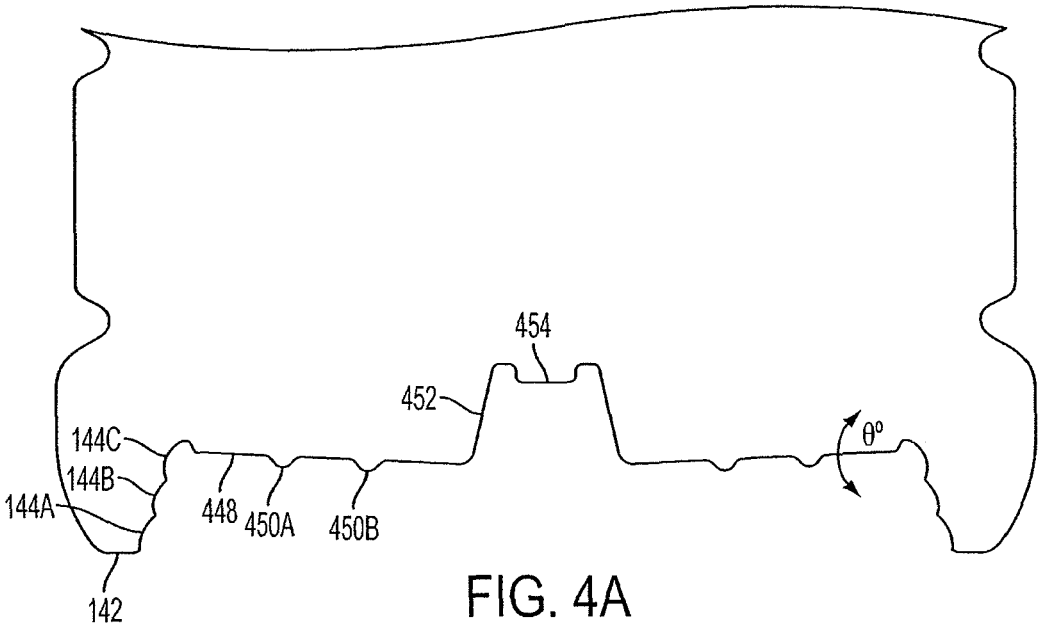
FIG. 4A is a cross section view of a base portion of a container according to embodiments of the disclosed subject matter.
Figure 4B:
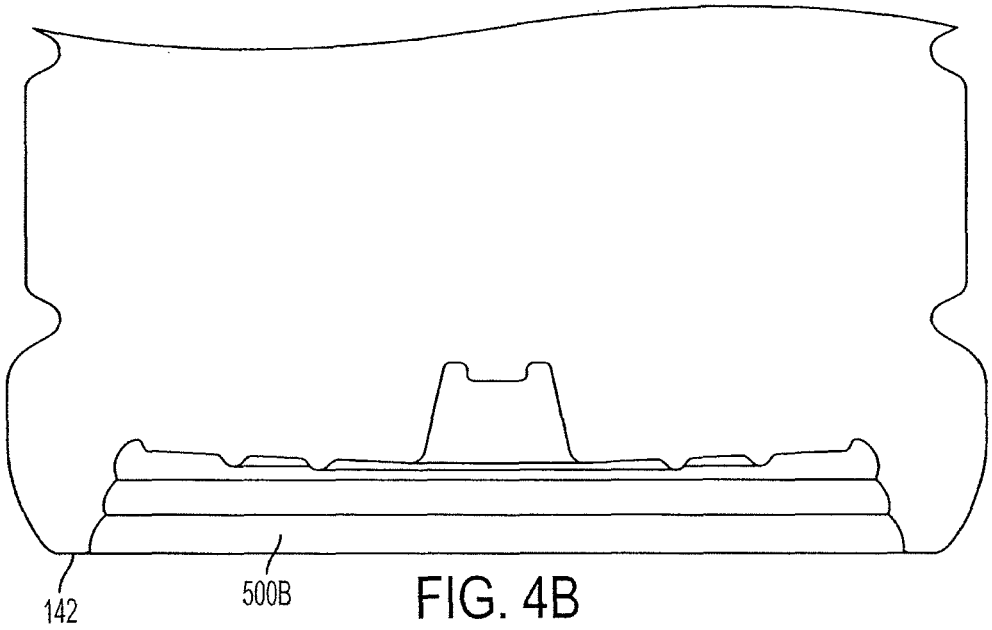
FIG. 4B is cross section view of the base portion shown in FIG. 4A with a base mold according to embodiments of the disclosed subject matter.
Figure 4C:
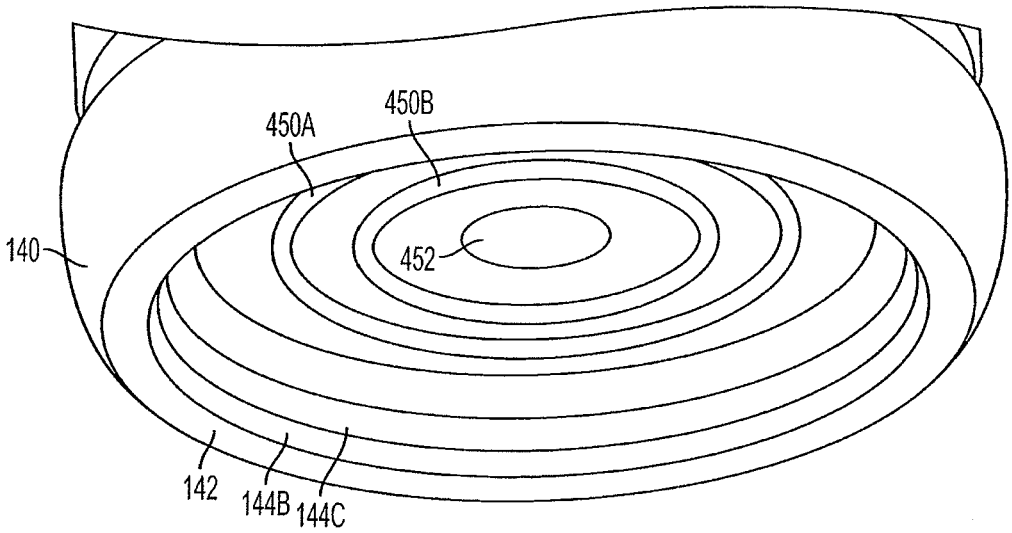
FIG. 4C is a bottom perspective view of the base portion of FIG. 4A.

FIGS. 4A-4C show an example of a jar base 142 with a three-ring up-stand wall 144A-C and with a particular configuration for the inner wall 448, with FIG. 4B also showing a base mold 500B for forming the jar base 142 shown in FIGS. 4A-4C. Inner wall 448 can be relatively flat with the exception of concentric rings 450A, 450B. Inner wall 448 also may include a nose cone 452 with a gate 454, which may be used for injection of plastic when blow molding the jar.

Generally speaking, inner wall 448 can move upward and/or downward by any suitable angle. Further, alternatively, in various embodiments, the angle of movement may be entirely below the initial, blow molded position of inner wall 448. Alternatively, the angle of movement may be entirely above the initial, blow molded position of inner wall 448. Or the angle of movement can bisect or split the initial blow molded position. In various embodiments, the initial blow molded position for inner wall 448 may be horizontal, or, alternatively, it may be three degrees above or below horizontal.

In various embodiments, inner wall 448 can flex downward, with concentric rings 450A, 450B controlling the extent to which the inner wall 448 may flex downward. Optionally, concentric rings 450A, 450B may assist inner wall 448 move back upward, for example to the initial blow molded position of the inner wall 448 or, for example, above the initial blow molded position. Such movement above the initial blow molded position may relieve some or all of an induced vacuum and even create a positive pressure within the jar.

Optionally, inner wall 448 also can have a nose cone (or gate riser) 452 with a gate 454 located at a central longitudinal axis of the jar, which may be used for injection of plastic when blow molding the jar. In various embodiments, nose cone 452 may serve as an anti-inverting portion that is constructed and operative to move downward in response to the increased pressure and/or upward in response to the decreased pressure without deforming or without substantially deforming as it moves upward and/or downward with the inner wall 448.

Figure 9A:
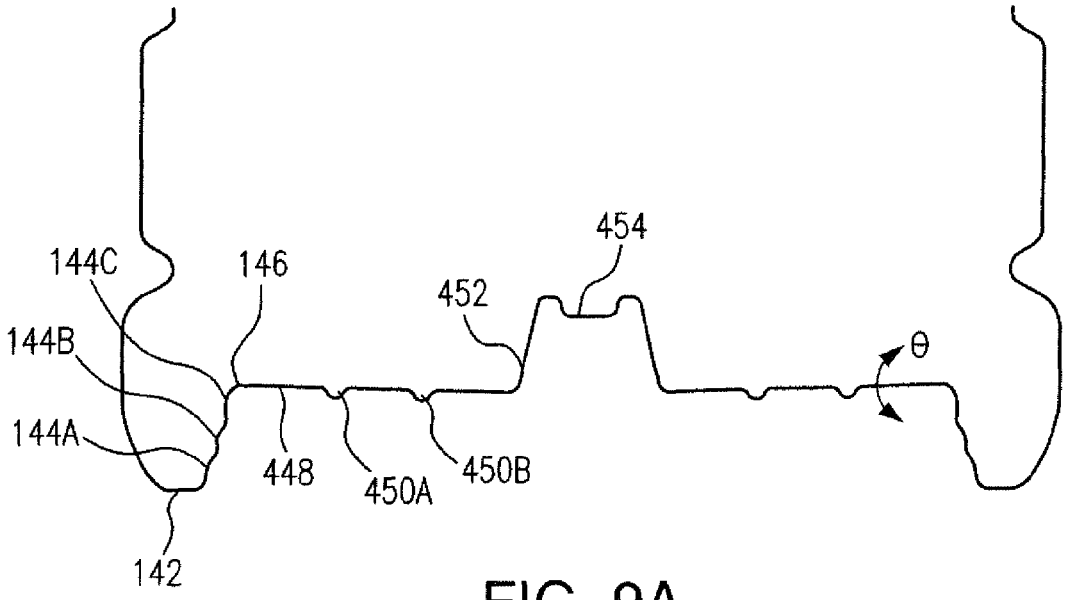
FIG. 9A is a cross section view of a base portion of a plastic container according to embodiments of the disclosed subject matter, similar to the base portion shown in FIG. 4A but without a ridge portion.

Another example, FIG. 9A shows, is a cross section, a base portion according to embodiments of the disclosed subject matter, without a ridge, and with item 146 now representing a horizontal, declined, or subtle radius downward transition from up-stand wall 144 to inner wall 148.

Figure 9B:
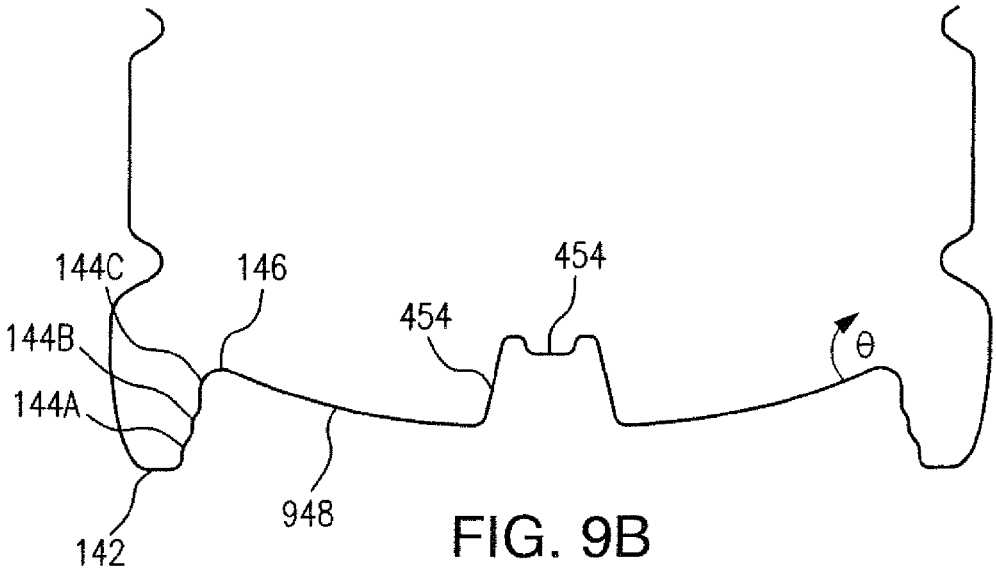
FIG. 9B is a cross section view of a base portion of a plastic container without a ridge portion according to embodiments of the disclosed subject matter.

FIG. 9B shows, in cross section, yet another example of a base portion according to embodiments of the disclosed subject matter without a ridge, with item 146 now representing a curved downward or parabolic transition from up-stand wall 144 to inner wall 148. Optionally, inner wall 148 can be curved axially outward along a single major radius.

Figure 5A:
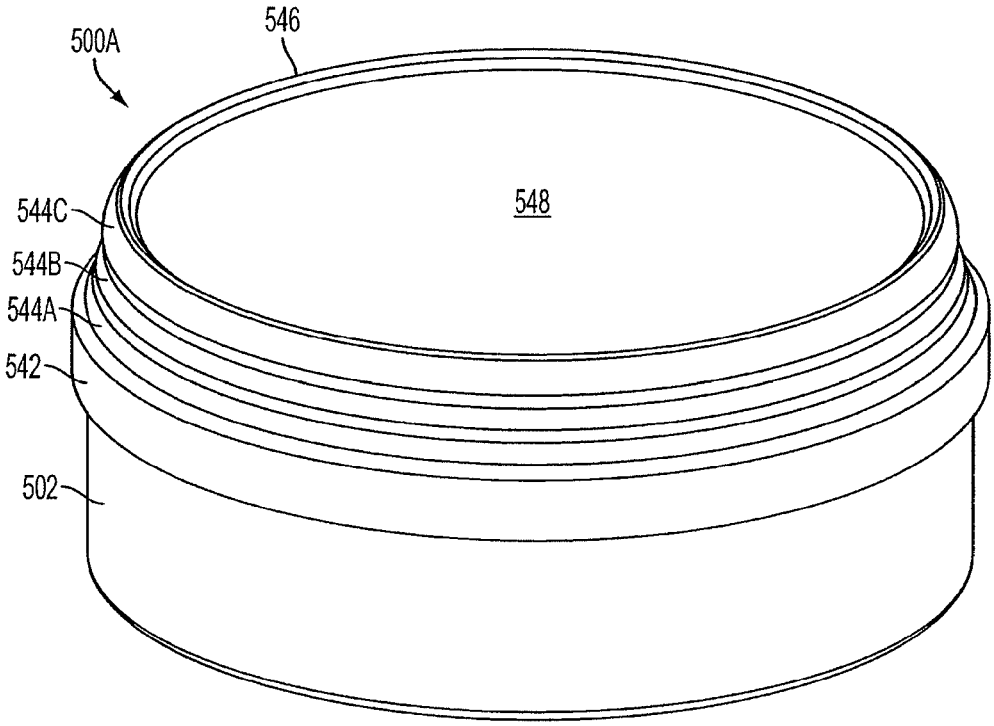
FIG. 5A is a base mold according to embodiments of the disclosed subject matter.

FIG. 5A is a base mold 500A to form a bottom end portion of a base of a plastic container according to embodiments of the disclosed subject matter. Base mold 500A include a body portion 502, a bearing surface forming portion 542 to form a portion of the bottom bearing surface, a ringed wall forming portion 544 to form the rigid ringed wall, a lip portion 546 to form a ridge of the bottom end portion, and an inner wall forming portion 548 to form a inner wall of a container. Ringed wall forming portion 544A-C may be comprised of a stack of three ring protrusions 544A-C to form a ringed wall of a container, wherein respective maximum diameters of the ring protrusions decrease in value from the bottom of the stack to the top of the stack.

Figure 5B:
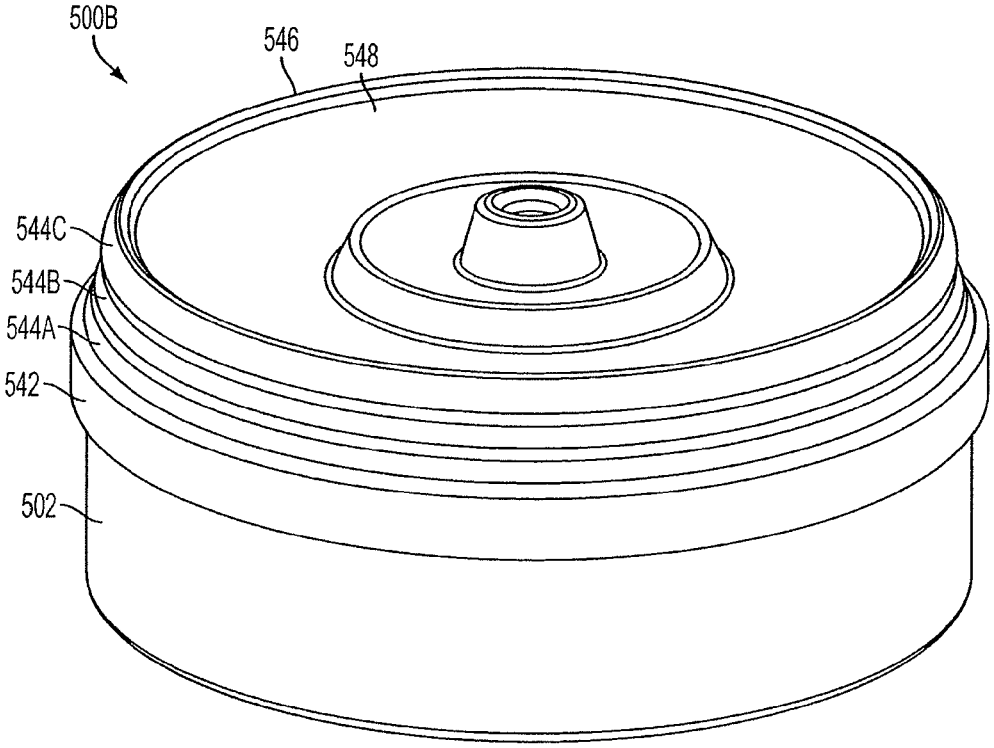
FIG. 5B is another base mold according to embodiments of the disclosed subject matter

Note that portion 548 shown in FIG. 5A is intended to indicate that any suitable inner wall can be formed (including as shown). FIG. 5B, for example, shows a base mold 500B with a specific inner wall forming portion 548. Base molds according to embodiments of the disclosed subject matter can for bottom end portions of container bases according container embodiments of the disclosed subject matter. Not explicitly shown by FIGS. 5A and 5B, base molds according to embodiments of the disclosed subject matter can be ridgeless (i.e., without a ridge forming portion or lip portion 546).

Figure 6:
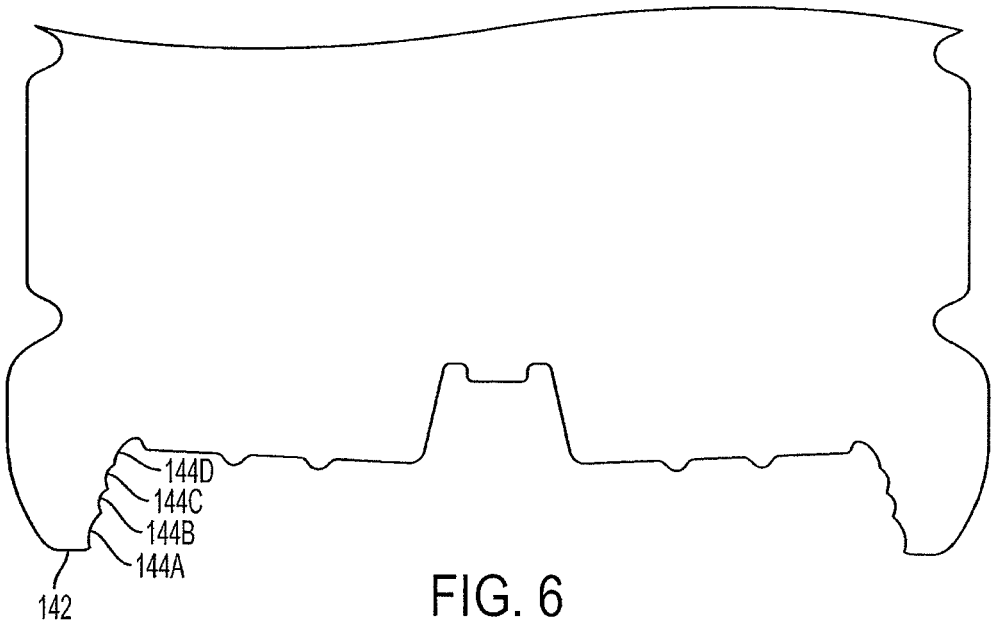
FIG. 6 shows a cross section view of an alternative embodiment of a base portion of a container according to the disclosed subject matter.
Figure 7:
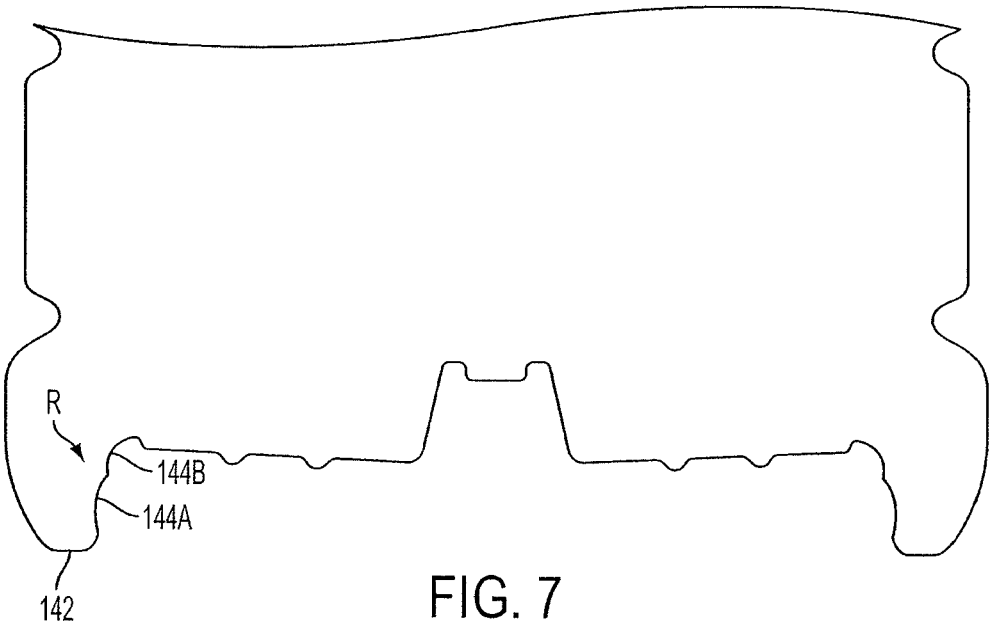
FIG. 7 shows a cross section view of another alternative embodiment of a base portion of a container according to the disclosed subject matter.
Figure 8A:
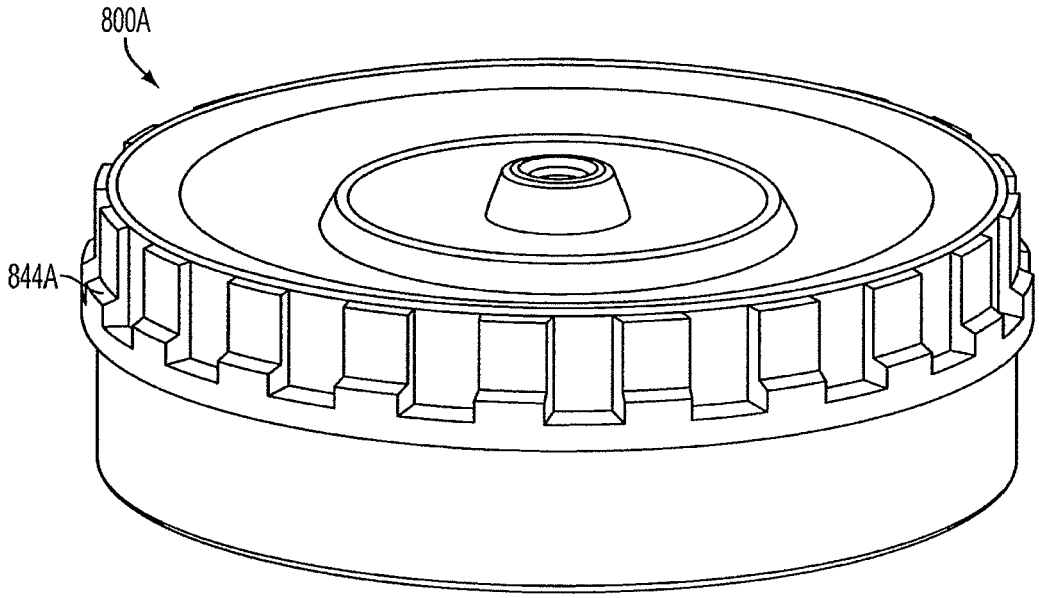
FIGS. 8A-8E illustrate alternative base mold embodiments according to the disclosed subject matter.
Figure 8B:
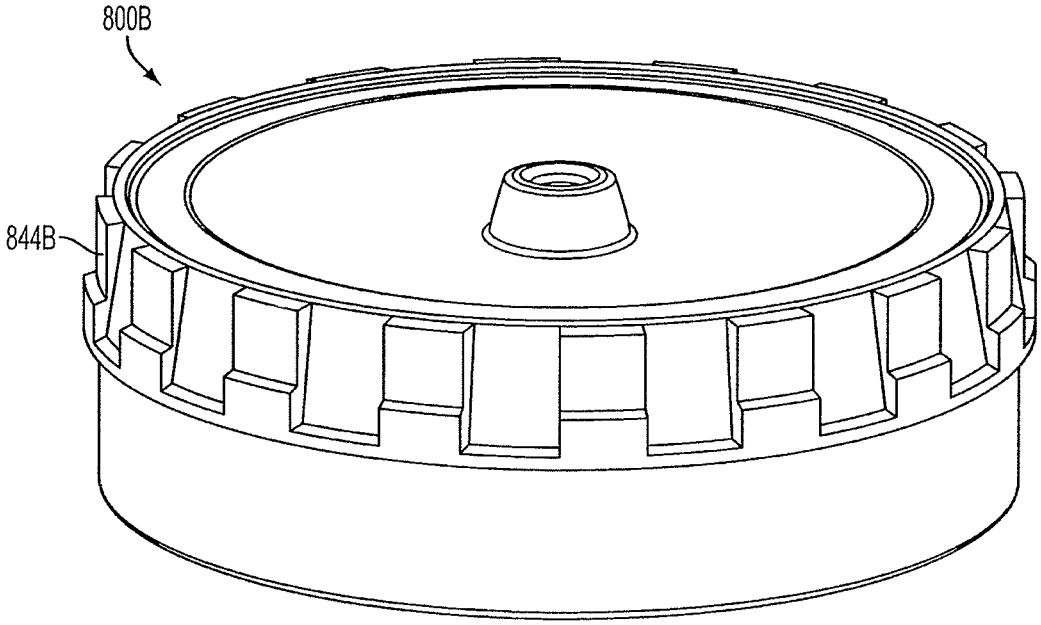
Figure 8C:
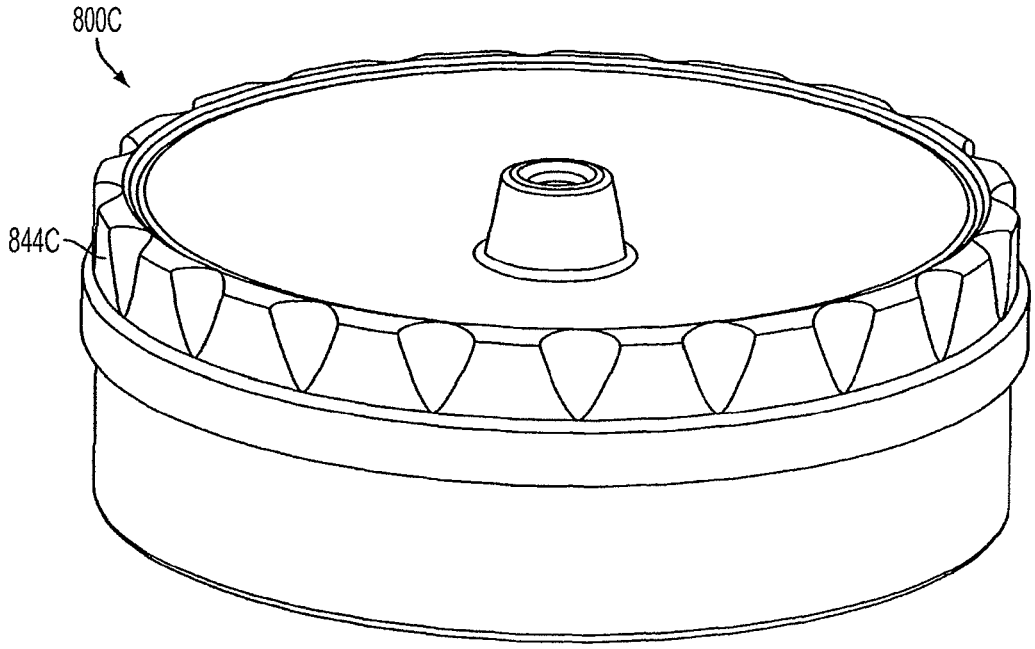
Figure 8D:
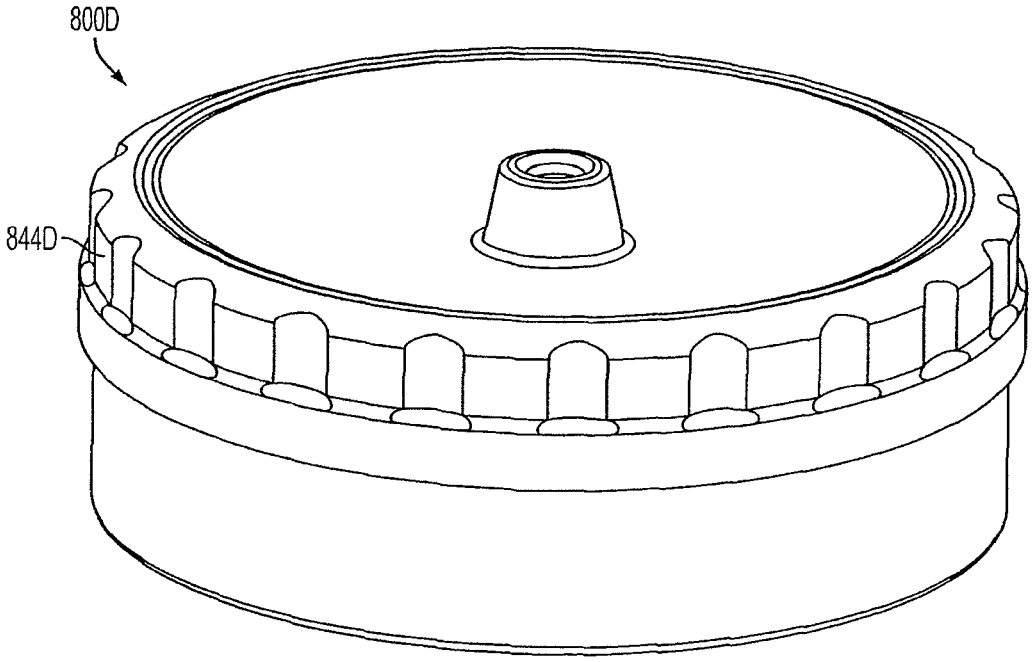
Figure 8E:
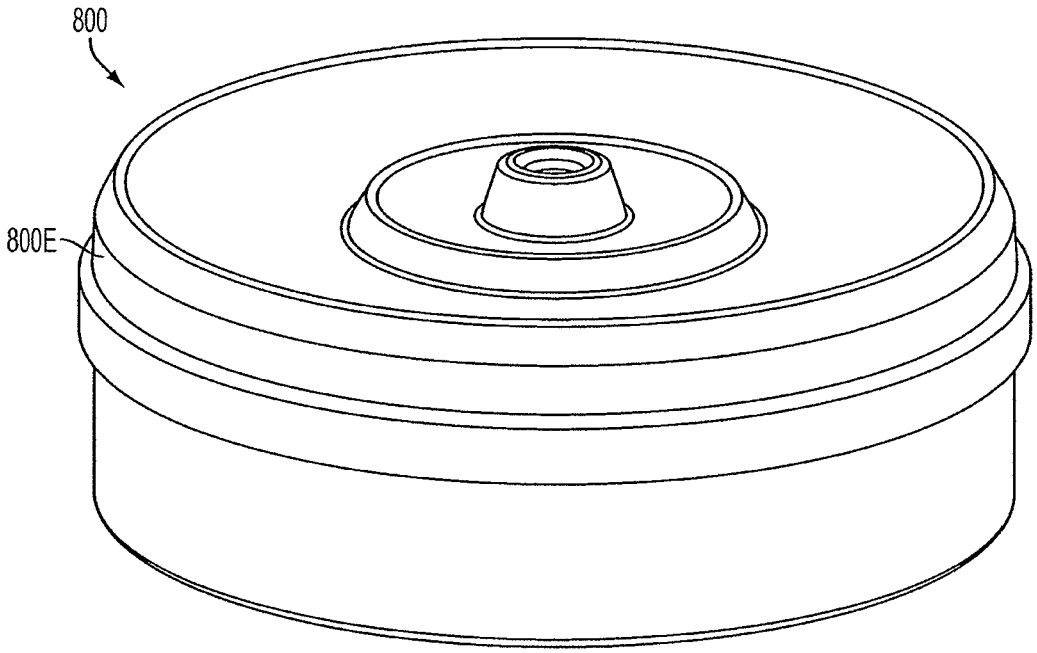

FIGS. 6 and 7 show alternative embodiments of up-stand wall 144. More specifically, up-stand wall 144 in FIG. 6 is comprised of four rings 144A-D, and up-stand wall 144 in FIG. 7 is comprised of two rings. The number of rings for up-stand wall 144 may be set for a particular container based on the food product or non-food product to be filled into the container. Rings 144 shown in FIGS. 6 and 7 can be of different configurations (e.g., different lengths of curvature (i.e., arc length), different heights, x-axis direction length, y-axis length, etc.).

FIGS. 8A-8E illustrate alternative base molds 800A-800E and respective up-stand geometries 844A-844E according to embodiments of the disclosed subject matter. Thus, this disclosure covers corresponding container bases and in particular up-stand wall configurations formed by these base molds 800A-800E and variations thereof.

Figure 10:
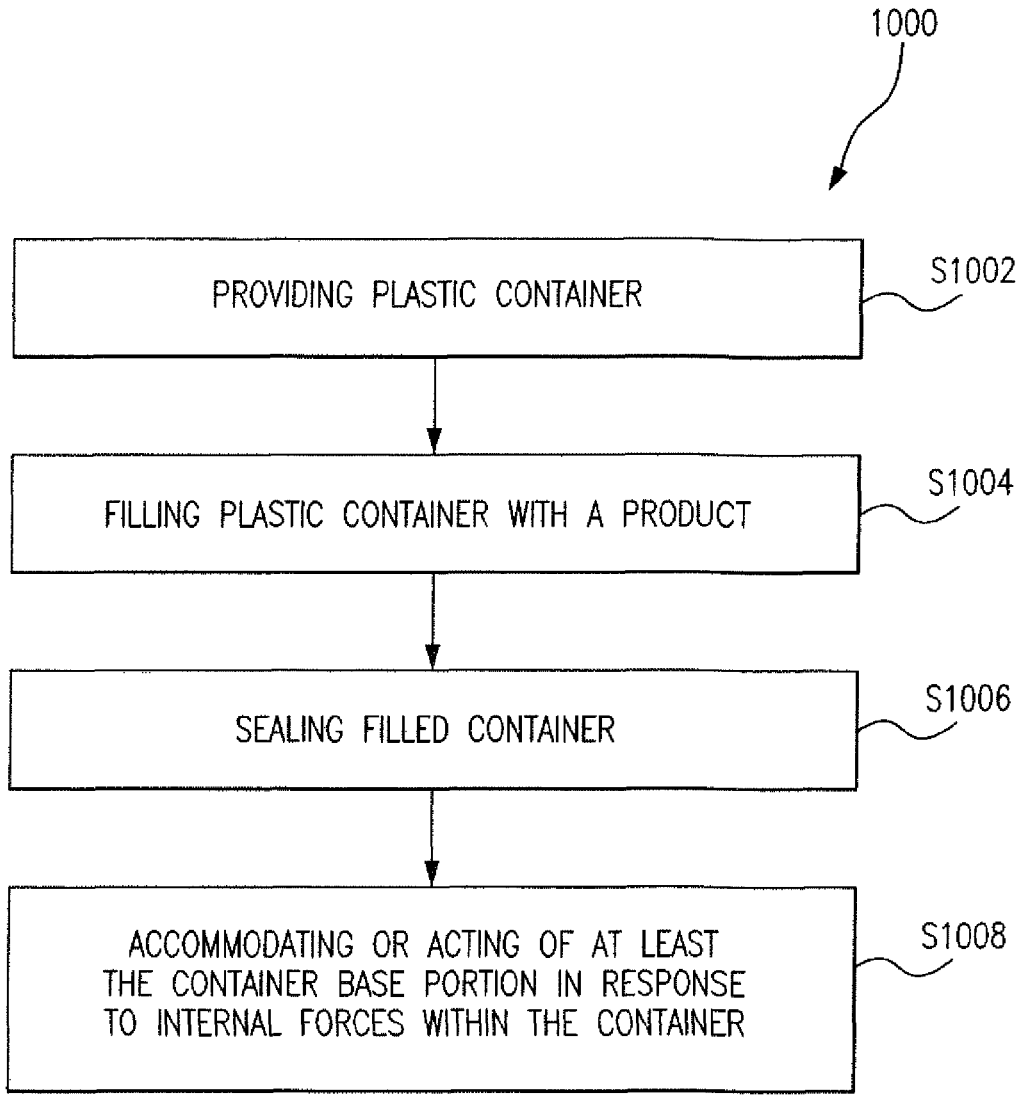
FIG. 10 is a flow chart for a method according to embodiments of the disclosed subject matter.

FIG. 10 is a flow chart for a method 1000 according to embodiments of the disclosed subject matter.

Methods according to embodiments of the disclosed subject matter can include providing a plastic container as set forth herein (S1002). Providing a plastic container can include blow molding or otherwise forming the container. Providing a plastic container also can include packaging, shipping, and/or delivery of a container. Methods can also include filling, for example, hot-filling the container with a product such as described herein, at a temperature as described herein (S1004). After filling, the container can be sealed with a closure such as described herein (S1006). After sealing filling and sealing the container, a base portion of the container can accommodate or act in response to an internal pressure or force in the filled and sealed container such as described herein (S1008). As indicated above, internal pressure within the sealed and filled container can be caused by hot-filling the container, pasteurization processing to the container, retort processing to the container, or cooling processing to the container. The container base portion can accommodate or act responsively as set forth herein based on the internal pressure or force and the particular configuration and construction of the base portion as set forth herein.

Though containers in the form of wide-mouth jars have been particularly discussed above and shown in various figures, embodiments of the disclosed subject matter are not limited to wide-mouth jars and can include plastic containers of any suitable shape or configuration and for any suitable use, including bottles, jugs, asymmetrical containers, single-serve containers or the like. Also, embodiments of the disclosed subject matter shown in the drawings have circular cross-sectional shapes with reference to a central longitudinal axis. However, embodiments of the disclosed subject matter are not limited to containers having circular cross sections and thus container cross sections can be square, rectangular, oval, or asymmetrical.

Further, as indicated above, hot-filling below 185° F. (e.g., 180° F.) or above 205° F. is also embodied in aspects of the disclosed subject matter. Pasteurizing and/or retort temperatures above 185°, above 200° F., or above 205° F. (e.g., 215° F.) are also embodied in aspects of the disclosed subject matter.

Containers, as set forth according to embodiments of the disclosed subject matter can be mode of a thermoplastic made in any suitable way, for example, blow molded (including injection) PET, PEN, or blends thereof. Additionally, optionally, containers according to embodiments of the disclosed subject matter can be multilayered, including a layer of gas barrier material, a layer of scrap material, and/or a polyester resin modified for ultra-violet ("UV") light protection or resistance.

Having now described embodiments of the disclosed subject matter, it should be apparent to those skilled in the art that the foregoing is merely illustrative and not limiting, having been presented by way of example only. Thus, although particular configurations have been discussed herein, other configurations can also be employed. Numerous modifications and other embodiments (e.g., combinations, rearrangements, etc.) are enabled by the present disclosure and are within the scope of one of ordinary skill in the art and are contemplated as falling within the scope of the disclosed subject matter and any equivalents thereto. Features of the disclosed embodiments can be combined, rearranged, omitted, etc., within the scope of the invention to produce additional embodiments. Furthermore, certain features may sometimes be used to advantage without a corresponding use of other features. Accordingly, Applicants intend to embrace all such alternatives, modifications, equivalents, and variations that are within the spirit and scope of the present invention.

The invention claimed is:

1. A jar comprising:

a cylindrical sidewall configured to support a wrap-around label;

a wide-mouth finish projecting from an upper end of said sidewall via a shoulder, said finish operative to receive a closure, and said shoulder defining an upper label stop above said sidewall; and a base defining a lower label stop below said sidewall, said base having a closed bottom end comprising:

an annular bearing portion defining a standing surface for the jar, the base being smooth and without surface features from said bearing portion to said lower label stop;

a cylindrical wall including a first concave ring, a second concave ring, and a third concave ring, the cylindrical wall circumscribed by said bearing portion and extending continuously upward from said bearing portion toward said wide-mouth finish generally in a radially inward direction, the first concave ring being continuous throughout a first circumference of the cylindrical wall and defined by a first diameter and a first cross-sectional radius, the second concave ring extending directly from the first concave ring continuous throughout a second circumference of the cylindrical wall and defined by a second diameter and a second cross-sectional radius, and the third concave ring extending directly from the second concave ring continuous throughout a third circumference of the cylindrical wall and defined by a third diameter and a third cross-sectional radius, the first diameter being greater than the second and third diameters, and the second diameter being greater than the third diameter; and an inner wall circumscribed by said cylindrical wall with an annular shoulder therebetween, said inner wall and said cylindrical wall are cooperatively operative so as to accommodate pressure variation within the jar after the jar has been hot-filled with a product at a temperature from 185° F. to 205° F. and sealed with the closure, said inner wall being operative to flex in response to the pressure variation within the jar after the jar has been hot-filled and sealed with the closure, whereas said cylindrical wall is operative to withstand movement as said inner wall flexes in response to the pressure variation within the jar after the jar has been hot-filled and sealed with the closure.

2. The jar according to claim 1, wherein said inner wall is moved upward and inward by a mechanical force acting on a central portion of said inner wall to create a positive pressure within the jar.

3. The jar according to claim 1, wherein the pressure variation includes increased pressure and decreased pressure, separately, wherein said inner wall resists and does not move downward in response to the increased pressure, and wherein said inner wall is caused to move upward in response to the decreased pressure to thereby accommodate the decreased pressure.

4. The jar according to claim 1, wherein each of said first, second, and third concave rings has a same vertical height.

5. The jar according to claim 1, wherein the pressure variation includes increased pressure associated with one or more of pasteurization processing and retort processing of the jar when filled and sealed with the closure.

6. The jar of claim 1, wherein the jar is made of a blow-molded plastic.

7. The jar according to claim 1, wherein the pressure variation is headspace pressure associated with the hot-filling with the product at the temperature from 185° F. to 205° F. and sealing the jar, said inner wall being configured and operative to flex downward in response to the headspace pressure, and wherein said sidewall withstands movement in response to the pressure variation.

8. The jar according to claim 7, wherein said inner wall is constructed so as to be at or above the bearing surface at all times when the inner wall flexes in response to the headspace pressure.

9. The jar according to claim 1, wherein the pressure variation is an internal vacuum associated with cooling of the hot-filled and sealed jar, said inner wall being configured and operative to flex upward and inward in response to the vacuum, and wherein said sidewall withstands movement in response to the vacuum.

10. The jar according to claim 9, wherein the upward and inward flexing of said inner wall at least partially reduces the vacuum in the jar.

11. The jar according to claim 9, wherein the upward and inward flexing of said inner wall entirely removes the vacuum in the jar.

12. The jar according to claim 1, wherein the pressure variation includes increased pressure and decreased pressure, separately, wherein said inner wall is constructed and operative to move downward in response to the increased pressure, and wherein said inner wall is constructed and operative to move upward in response to the decreased pressure to thereby accommodate the decreased pressure.

13. The jar according to claim 12, wherein said inner wall includes an anti-inverting portion at a central longitudinal axis of the jar, said anti-inverting portion being constructed and operative to move downward in response to the increased pressure and upward in response to the decreased pressure without deforming.

14. A container comprising:

a sidewall;

a finish projecting from an upper end of said sidewall, said finish operative to receive a closure; and a base below said sidewall, said base having a closed bottom end comprising:

an annular bearing portion defining a standing surface for the container;

a cylindrical wall including a first concave ring, a second concave ring, and a third concave ring, the cylindrical wall circumscribed by said bearing portion and extending continuously upward from said bearing portion toward said wide-mouth finish generally in a radially inward direction, the first concave ring being continuous throughout a first circumference of the cylindrical wall and defined by a first diameter and a first cross-sectional radius, the second concave ring extending directly from the first concave ring continuous throughout a second circumference of the cylindrical wall and defined by a second diameter and a second cross-sectional radius, and the third concave ring extending directly from the second concave ring continuous throughout a third circumference of the cylindrical wall and defined by a third diameter and a third cross-sectional radius, the first diameter being greater than the second and third diameters, and the second diameter being greater than the third diameter; and an inner wall circumscribed by said cylindrical wall with an annular shoulder therebetween, said inner wall and said cylindrical wall being cooperatively operative so as to accommodate pressure variation within the container after the container has been filled with a product and sealed with the closure, said inner wall being operative to flex in response to the pressure variation within the container after the container has been hot-filled and sealed with the closure, whereas said cylindrical wall is operative to withstand movement as said inner wall flexes in response to the pressure variation within the container after the container has been hot-filled and sealed with the closure.

15. The container of claim 14, wherein the container is made of plastic.

* * * * *